US006383237B1

(12) United States Patent
Langer et al.

(10) Patent No.: US 6,383,237 B1
(45) **Date of Patent: *May 7, 2002**

(54) PROCESS AND APPARATUS FOR MAKING AQUEOUS HYDROCARBON FUEL COMPOSITIONS, AND AQUEOUS HYDROCARBON FUEL COMPOSITIONS

(76) Inventors: Deborah A. Langer, 12404 Rock Haven, Chesterland, OH (US) 44026; David L. Westfall, 2217 Morrison Ave., Lakewood, OH (US) 44107; Morris E. Smith, 2945 Pilgrim Mill Rd., Cumming, GA (US) 30041; Robert T. Graf, 387 Medway Rd.; Harshida Dave, 495 Longspur Rd., both of Highland Heights, OH (US) 44143; John J. Mullay, 9251 Lori Jean Dr., Mentor, OH (US) 44060; Daniel T. Daly, 33166 Popham La., Solon, OH (US) 44139; Elizabeth A. Schiferl, 18 Briarberry Ct., Greer, SC (US) 29651; Brian B. Filippini, 5800 S. Winds Dr., Apt. 132, Mentor-on-the-Lake, OH (US) 44060; William D. Abraham, 3835 Merrymound Rd., South Euclid, OH (US) 44121; Jennifer N. Fakult, 2260 Par La., No. 809, Willoughby Hills, OH (US) 44094

( * ) Notice: Subject to any disclaimer, the term of this patent is extended or adjusted under 35 U.S.C. 154(b) by 0 days.

This patent is subject to a terminal disclaimer.

(21) Appl. No.: 09/483,481

(22) Filed: Jan. 14, 2000

Related U.S. Application Data

(63) Continuation-in-part of application No. 09/390,925, filed on Sep. 7, 1999, which is a continuation-in-part of application No. 09/349,268, filed on Jul. 7, 1999.

(51) Int. Cl.[7] ..... C10L 1/32

(52) U.S. Cl. ..... 44/301; 44/302; 44/325; 44/326; 44/331; 44/386

(58) Field of Search ..... 44/301

(56) References Cited

U.S. PATENT DOCUMENTS

| | | | | |
|---|---|---|---|---|
| 2,619,330 A | 11/1952 | Willems | ..... | 259/96 |
| 2,858,200 A | 10/1958 | Broughten | ..... | 44/57 |

(List continued on next page.)

FOREIGN PATENT DOCUMENTS

| | | | | |
|---|---|---|---|---|
| AU | 711348 | 3/1997 | ..... | 1/32 |
| WO | WO 97/34969 | 3/1997 | ..... | 1/32 |
| WO | WO99/13028 | 3/1999 | | |
| WO | WO 99/13029 | 3/1999 | | |
| WO | WO 99/13030 | 3/1999 | | |
| WO | WO 99/13031 | 3/1999 | | |

OTHER PUBLICATIONS

Written Opinion mailed Apr. 12, 2001 for International Application No. PCT/US00/17767.

(List continued on next page.)

*Primary Examiner*—Ellen M. McAvoy
(74) *Attorney, Agent, or Firm*—Teresan W. Gilbert; Michael F. Esposito

(57) ABSTRACT

This invention relates to a process for making an aqueous hydrocarbon fuel composition, comprising: (A) mixing a normally liquid hydrocarbon fuel and at least one chemical additive to form a hydrocarbon fuel-additive mixture; and (B) mixing said hydrocarbon fuel-additive mixture with water under high shear mixing conditions in a high shear mixer to form said aqueous hydrocarbon fuel composition, said aqueous hydrocarbon fuel composition including a discontinuous aqueous phase, said discontinuous aqueous phase being comprised of aqueous droplets having a mean diameter of 1.0 micron or less. An apparatus for operating the foregoing process is also disclosed. Aqueous hydrocarbon fuel compositions are disclosed.

66 Claims, 5 Drawing Sheets

U.S. PATENT DOCUMENTS

| | | | | | |
|---|---|---|---|---|---|
| 3,499,632 | A | | 3/1970 | Piros | 259/4 |
| 3,756,794 | A | | 9/1973 | Ford | 44/51 |
| 3,818,876 | A | | 6/1974 | Voogd | 123/25 R |
| 3,855,103 | A | | 12/1974 | McLaren et al. | 204/306 |
| 3,876,391 | A | | 4/1975 | McCoy et al. | 44/51 |
| 4,048,080 | A | | 9/1977 | Lee et al. | 252/51.5 A |
| 4,084,940 | A | | 4/1978 | Lissant | 44/51 |
| 4,146,499 | A | | 3/1979 | Rosano | 252/186 |
| 4,207,078 | A | | 6/1980 | Sweeney et al. | 44/68 |
| 4,329,249 | A | | 5/1982 | Forsberg | 252/34.7 |
| 4,388,893 | A | | 6/1983 | Apfel | 123/255 |
| 4,433,917 | A | | 2/1984 | Mendel et al. | 366/132 |
| 4,438,731 | A | | 3/1984 | Maggio | 123/25 N |
| 4,447,348 | A | | 5/1984 | Forsberg | 252/75 |
| 4,452,712 | A | | 6/1984 | Laemmle | 252/49.3 |
| 4,482,356 | A | | 11/1984 | Hanlon | 44/57 |
| 4,561,861 | A | | 12/1985 | Davis et al. | 44/51 |
| 4,585,461 | A | | 4/1986 | Gorman | 44/53 |
| 4,613,341 | A | | 9/1986 | Zaweski et al. | 44/51 |
| 4,621,927 | A | | 11/1986 | Hiroi | 366/132 |
| 4,697,929 | A | | 10/1987 | Muller | 366/97 |
| 4,708,753 | A | | 11/1987 | Forsberg | 149/2 |
| 4,776,977 | A | | 10/1988 | Taylor | 252/314 |
| 4,892,562 | A | | 1/1990 | Bowers et al. | 44/67 |
| 4,907,368 | A | * | 3/1990 | Mullay et al. | 44/301 |
| 4,908,154 | A | | 3/1990 | Cook et al. | 252/314 |
| 4,916,631 | A | | 4/1990 | Crain et al. | 364/502 |
| 4,938,606 | A | | 7/1990 | Kunz | 366/134 |
| 4,953,097 | A | | 8/1990 | Crain et al. | 364/502 |
| 4,983,319 | A | | 1/1991 | Gregoli et al. | 252/314 |
| 4,986,858 | A | | 1/1991 | Oliver et al. | 149/109.6 |
| 5,000,757 | A | | 3/1991 | Puttock et al. | 44/301 |
| 5,104,621 | A | | 4/1992 | Pfost et al. | 422/67 |
| 5,279,626 | A | | 1/1994 | Cunningham et al. | 44/331 |
| 5,352,377 | A | | 10/1994 | Blain et al. | 252/51.5 R |
| 5,389,111 | A | | 2/1995 | Nikanjam et al. | 44/300 |
| 5,389,112 | A | | 2/1995 | Nikanjam et al. | 44/300 |
| 5,399,293 | A | | 3/1995 | Nunez et al. | 252/314 |
| 5,404,841 | A | | 4/1995 | Valentine | 123/25 E |
| 5,411,558 | A | | 5/1995 | Taniguchi et al. | 44/301 |
| 5,445,656 | A | | 8/1995 | Marelli | 44/301 |
| 5,454,964 | A | | 10/1995 | Blackborow et al. | 252/56 D |
| 5,478,365 | A | | 12/1995 | Nikanjam et al. | 44/280 |
| 5,501,714 | A | | 3/1996 | Valentine et al. | 44/358 |
| 5,503,372 | A | | 4/1996 | Rivas et al. | 252/314 |
| 5,544,856 | A | | 8/1996 | King et al. | 251/129.08 |
| 5,556,574 | A | | 9/1996 | Rivas et al. | 252/311.5 |
| 5,563,189 | A | | 10/1996 | Hosokawa et al. | 523/322 |
| 5,584,326 | A | | 12/1996 | Galli | 141/83 |
| 5,622,920 | A | | 4/1997 | Rivas et al. | 507/232 |
| 5,624,999 | A | | 4/1997 | Lombardi et al. | 525/52 |
| 5,632,596 | A | | 5/1997 | Ross | 415/83 |
| 5,643,528 | A | | 7/1997 | Le Gras | 266/88 |
| 5,669,938 | A | | 9/1997 | Schwab | 44/301 |
| 5,682,842 | A | | 11/1997 | Coleman et al. | 123/25 C |
| 5,706,896 | A | | 1/1998 | Tubel et al. | 166/313 |
| 5,743,922 | A | | 4/1998 | Peter-Hoblyn et al. | 44/301 |
| 5,746,783 | A | | 5/1998 | Compere et al. | 44/301 |
| 5,792,223 | A | | 8/1998 | Rivas et al. | 44/302 |
| 5,851,245 | A | | 12/1998 | Moriyama et al. | 44/301 |
| 5,862,315 | A | | 1/1999 | Glaser et al. | 395/182.09 |
| 5,863,301 | A | | 1/1999 | Grosso et al. | 44/301 |
| 5,868,201 | A | | 2/1999 | Bussear et al. | 166/53 |
| 5,873,916 | A | | 2/1999 | Cemenska et al. | 44/301 |
| 5,879,079 | A | | 3/1999 | Hohmann et al. | 366/151.1 |
| 5,879,419 | A | | 3/1999 | Moriyama et al. | 44/301 |
| 5,895,565 | A | | 4/1999 | Steininger et al. | 210/85 |
| 5,896,292 | A | | 4/1999 | Hosaka et al. | 364/468.15 |
| 5,912,213 | A | * | 6/1999 | Baker et al. | 508/452 |
| 6,017,368 | A | * | 1/2000 | Steinmann | 44/302 |
| 6,030,424 | A | * | 2/2000 | Matsumoto | 44/301 |
| 6,068,670 | A | | 5/2000 | Haupais et al. | 44/301 |

OTHER PUBLICATIONS

KADY International; Continuous Flow Dispersion Mills; 2/98; 5 pages (brochure).

IKA, Inc.; Batch Mixers, A Closer Look (www.silverson-.com/btchmxr2.htm); Mar. 18, 1999 (printed from internet); 4 pages.

Sonic Corp.; Tri–Homo Colloid Mills, catalog TH980; 4 pages (no date).

Sonic Corp.; Ultrasonic Mixing (brochure); 6 pages (no date).

IKA; Maschinenbau Dispersing (brochure); 40 pages.

Becher; Emulsions, Theory and Practice, $2^{nd}$ Edition, pp. 267–325, 1965.

Coughanowr et al.; "Process Systems Analysis and Control"; McGraw–Hill Book Company; pp ix–x; 1965.

* cited by examiner

PROCESS AND APPARATUS FOR MAKING AQUEOUS HYDROCARBON FUEL COMPOSITIONS, AND AQUEOUS HYDROCARBON FUEL COMPOSITIONS

This application is a continuation-in-part of U.S. application Ser. No. 09/390,925, filed on Sep. 7, 1999 now pending, that is a continuation-in-part of U.S. application Ser. No. 09/349,268, filed Jul. 7, 1999 now pending. Each of the disclosures of both prior applications is incorporated herein by reference in its entirety.

TECHNICAL FIELD

This invention relates to a process and apparatus for making aqueous hydrocarbon fuel compositions. The invention also relates to stable aqueous hydrocarbon fuel compositions. The process and apparatus are suitable for dispensing the fuels to end users in wide distribution networks.

BACKGROUND OF THE INVENTION

Internal combustion engines, especially diesel engines, using water mixed with fuel in the combustion chamber can produce lower $NO_x$, hydrocarbon and particulate emissions per unit of power output. However, a problem with adding water relates to the fact that emulsions form in the fuel and these emulsions tend to be unstable. This has reduced the utility of these fuels in the marketplace. It would be advantageous to enhance the stability of these fuels sufficiently to make them useful in the marketplace. Another problem relates to the fact that due to the instability associated with these fuels, it is difficult to make them available to end users in a wide distribution network. The fuels tend to break down before they reach the end user. It would be advantageous to provide a process and apparatus that could be used for blending these fuels at the dispensing site for the end user and therefore make the fuels available to end users in wide distribution networks.

SUMMARY OF THE INVENTION

This invention provides for a process for making an aqueous hydrocarbon fuel composition, comprising: (A) mixing a normally liquid hydrocarbon fuel and at least one chemical additive to form a hydrocarbon fuel-additive mixture; and (B) mixing said hydrocarbon fuel-additive mixture with water under high-shear mixing conditions in a high-shear mixer to form said aqueous hydrocarbon fuel composition, said aqueous hydrocarbon fuel composition including a discontinuous aqueous phase, said discontinuous aqueous phase being comprised of aqueous droplets having a mean diameter of 1.0 micron or less. A critical feature of this invention relates to the fact that the aqueous phase droplets have a mean diameter of 1.0 micron or less. This feature is directly related to the enhanced stability characteristics of the inventive aqueous hydrocarbon fuel compositions.

This invention further provides for an apparatus for making an aqueous hydrocarbon fuel composition, comprising: a high shear mixer; a blend tank; a chemical additive storage tank and a pump and conduit for transferring a chemical additive from said chemical additive storage tank to said blend tank; a conduit for transferring a hydrocarbon fuel from a hydrocarbon fuel source to said blend tank; a conduit for transferring a hydrocarbon fuel-additive mixture from said blend tank to said high-shear mixer; a water conduit for transferring water from a water source to said high-shear mixer; a fuel storage tank; a conduit for transferring an aqueous hydrocarbon fuel composition from said high-shear mixer to said fuel storage tank; a conduit for dispensing said aqueous hydrocarbon fuel composition from said fuel storage tank; a programmable logic controller for controlling: (i) the transfer of said chemical additive from said chemical additive storage tank to said blend tank; (ii) the transfer of said hydrocarbon fuel from said hydrocarbon fuel source to said blend tank; (iii) the transfer of said hydrocarbon fuel-additive mixture from said blend tank to said high shear mixer; (iv) the transfer of water from said water source to said high shear mixer; (v) the mixing of said hydrocarbon fuel-additive mixture and said water in said high shear mixer; and (vi) the transfer of said aqueous hydrocarbon fuel composition from said high shear mixer to said fuel storage tank; and a computer for controlling said programmable logic controller.

In one embodiment, the inventive apparatus is in the form of a containerized equipment package or unit that operates automatically. This unit can be programmed and monitored locally at the site of its installation, or it can be programmed and monitored from a location remote from the site of its installation. The fuel is dispensed to end users at the installation site. This provides a way to make the aqueous hydrocarbon fuels compositions prepared in accordance with the invention available to end users in wide distribution networks.

This invention also relates to an aqueous hydrocarbon fuel composition comprising: a continuous phase of a normally liquid hydrocarbon fuel; a discontinuous aqueous phase, said discontinuous aqueous phase being comprised of aqueous droplets having a mean diameter of 1.0 micron or less; and an emulsifying amount of an emulsifier composition comprising (i) a hydrocarbon fuel-soluble product made by reacting a hydrocarbyl-substituted carboxylic acid acylating agent with ammonia or an amine, the hydrocarbyl substituent of said acylating agent having about 50 to about 500 carbon atoms, (ii) an ionic or a nonionic compound having a hydrophilic lipophilic balance (HLB) of about 1 to about 10, or a mixture of (i) and (ii), in combination with (iii) a water-soluble salt distinct from (i) and (ii). In a preferred embodiment, component (i) is a combination of (i)(a) at least one reaction product of an acylating agent with an alkanol amine and (i)(b) at least one reaction product of an acylating agent with at least one ethylene polyamine. Preferably, component (i)(b) is combined with component (i)(a) in an amount from about 0.05% to about 0.95% based upon the total weight of component (i).

BRIEF DESCRIPTION OF THE DRAWINGS

In the annexed drawings, like parts and features have like designations.

DETAILED DESCRIPTION OF THE PREFERRED EMBODIMENTS

As used herein, the terms "hydrocarbyl substituent," "hydrocarbyl group," "hydrocarbyl-substituted," "hydrocarbon group," and the like, are used to refer to a group having one or more carbon atoms directly attached to the remainder of a molecule and having a hydrocarbon or predominantly hydrocarbon character. Examples include:

(1) purely hydrocarbon groups, that is, aliphatic (e.g., alkyl, alkenyl or alkylene), and alicyclic (e.g., cycloalkyl, cycloalkenyl) groups, aromatic groups, and aromatic-, aliphatic-, and alicyclic-substituted aromatic groups, as well as cyclic groups wherein the ring is completed through another portion of the molecule (e.g., two substituents together forming an alicyclic group);

(2) substituted hydrocarbon groups, that is, hydrocarbon groups containing non-hydrocarbon groups that, in the context of this invention, do not alter the predominantly hydrocarbon nature of the group (e.g., halo, hydroxy, alkoxy, mercapto, alkylmercapto, nitro, nitroso, and sulfoxy);

(3) hetero substituted hydrocarbon groups, that is, hydrocarbon groups containing substituents that, while having a predominantly hydrocarbon character, in the context of this invention, contain other than carbon in a ring or chain otherwise composed of carbon atoms. Heteratoms include sulfur, oxygen, nitrogen. In general, no more than two, and in one embodiment no more than one, non-hydrocarbon substituent is present for every ten carbon atoms in the hydrocarbon group.

The term "lower" when used in conjunction with terms such as alkyl, alkenyl, and alkoxy, is intended to describe such groups that contain a total of up to 7 carbon atoms.

The term "water-soluble" refers to materials that are soluble in water to the extent of at least one gram per 100 milliliters of water at 25° C.

The term "fuel-soluble" refers to materials that are soluble in a normally liquid hydrocarbon fuel (e.g. gasoline or diesel fuel) to the extent of at least one gram per 100 milliliters of fuels at 25° C.

The Process and Apparatus

Figure 1:
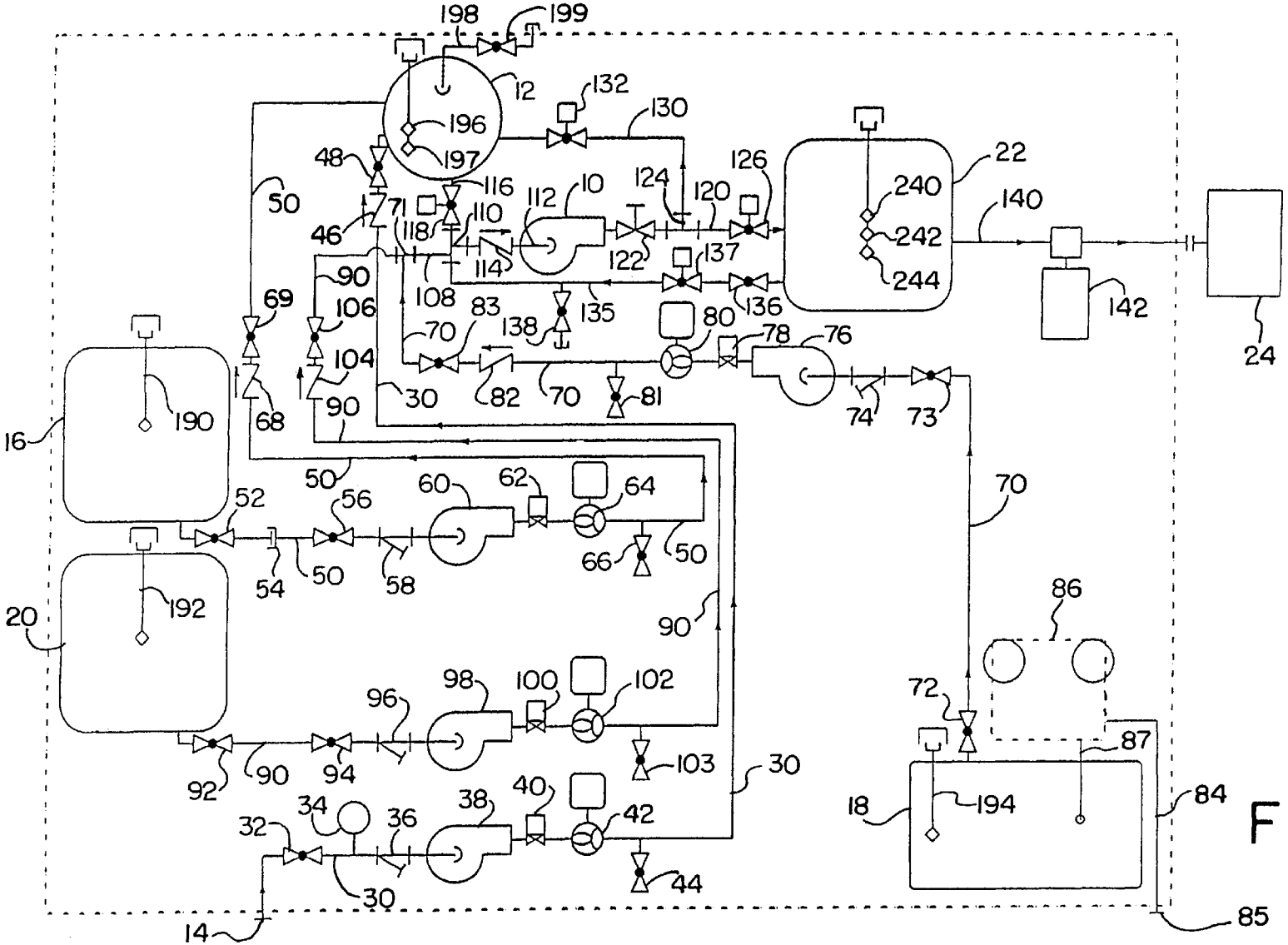
FIG. 1 is a flow sheet illustrating one embodiment of the inventive process and apparatus.

The inventive process may be conducted on a batch basis or on a continuous basis. The process and apparatus described below relates to a batch process. Referring initially to FIG. 1, the apparatus includes high shear mixer 10, blend tank 12, hydrocarbon fuel inlet 14, chemical additive storage tank 16, water storage tank 18, antifreeze agent storage tank 20, aqueous hydrocarbon fuel storage tank 22, and fuel dispenser 24.

Hydrocarbon fuel enters through hydrocarbon fuel inlet 14 and flows to blend tank 12 through conduit 30. Arranged in series along conduit 30 between inlet 14 and blend tank 12 are isolation valve 32, pressure gauge 34, strainer 36, pump 38, solenoid valve 40, flow meter and totalizer 42, calibration outlet valve 44, check valve 46 and isolation valve 48.

Conduit 50 extends from chemical additive storage tank 16 to blend tank 12 and is adapted for transferring the chemical additive from chemical additive storage tank 16 to blend tank 12. Arranged in series along conduit 50 are isolation valve 52, quick disconnect 54, isolation valve 56, strainer 58, pump 60, solenoid valve 62, flow meter and totalizer 64, calibration outlet valve 66, check valve 68 and isolation valve 69.

Conduit 70 extends from water storage tank 18 to connecting tee 71 where it connects with conduit 90. Arranged in series along conduit 70 between water storage tank 18 and connecting tee 71 are valves 72 and 73, strainer 74, pump 76, solenoid valve 78, flow meter and totalizer 80, calibration outlet valve 81, check valve 82, and isolation valve 83. Conduit 84 extends from water inlet 85 to water deionizer 86. Conduit 87 extends from water deionizer 86 to water storage tank 18 Conduit 90 extends from antifreeze storage tank 20 to connecting tee 71. Arranged in series along conduit 90 between antifreeze agent storage tank 20 and connecting tee 71 are valves 92 and 94, strainer 96, pump 98, solenoid valve 100, flow meter and totalizer 102, check valve 104 and isolation valve 106.

Conduit 108 extends from connecting tee 71 to connecting tee 110. Conduit 116 extends from blend tank 12 to connecting tee 110. Actuated valve 118 is positioned between blend tank 12 and connecting tee 110 in conduit 116. Conduit 112 extends from connecting tee 110 to the inlet to high shear mixer 10. Check valve 114 is located in conduit 112 between connecting tee 110 and the inlet to high shear mixer 10.

Conduit 120 extends from the outlet to high shear mixer 10 to aqueous hydrocarbon fuel storage tank 22. Arranged in series along conduit 120 are throttling valve 122, connecting tee 124 and actuated valve 126. Conduit 130 extends from connector tee 124 to blend tank 12. Actuated valve 132 is positioned in conduit 130 between connecting tee 124 and blend tank 12. Conduit 130 is provided for recycling the mixture of hydrocarbon fuel-additive mixture and water (and optionally antifreeze agent) back through blend tank 12 and then again through high shear mixer 10.

Conduit 135 extends from aqueous hydrocarbon fuel storage tank 22 to connecting tee 110 and is provided for recycling aqueous hydrocarbon fuel composition from tank 22 back through high shear mixer 10 when it is desired to subject the aqueous hydrocarbon fuel composition to additional high shear mixing. Arranged in series along conduit 135 are isolation valve 136, actuated valve 137 and calibration outlet valve 138. This recycling can be done to avoid undesired settling in tank 22 after the aqueous hydrocarbon fuel composition has been blended.

Conduit 140 extends from aqueous hydrocarbon fuel storage tank 22 to fuel dispenser 24. Dispensing pump 142 is connected to conduit 140 and is positioned between aqueous hydrocarbon fuel storage tank 22 and fuel dispenser 24. Dispensing pump 142 is adapted for pumping the aqueous hydrocarbon fuel composition from aqueous hydrocarbon fuel storage tank 22 to fuel dispenser 24. Users of the aqueous hydrocarbon fuel composition may obtain the fuel from dispenser 24.

A programmable logic controller (PLC), not shown in FIG. 1, is provided for controlling: (i) the transfer of chemical additive from the chemical additive storage tank 16 to blend tank 12; (ii) the transfer of hydrocarbon fuel from hydrocarbon fuel inlet 14 to the blend tank 12; (iii) the transfer of hydrocarbon fuel-additive mixture from the blend tank 12 to high shear mixer 10; (iv) the transfer of water from the water storage tank 18 to high shear mixer 10; (v)

the mixing in high shear mixer 10 of the hydrocarbon fuel-additive mixture and the water; and (vi) the transfer of the aqueous hydrocarbon fuel composition from the high shear mixer 10 to the aqueous hydrocarbon fuel storage tank 22. When, an antifreeze agent is used, the PLC controls the transfer of the antifreeze agent from the antifreeze agent storage tank 20 to connecting tee 71 where it is mixed with water from conduit 70. When it is desired to recycle the aqueous hydrocarbon fuel composition through mixer 10 for additional high shear mixing, the PLC also controls such recycling. The PLC stores component percentages input by the operator. The PLC then uses these percentages to define volumes of each component required. A blending sequence is programmed into the PLC. The PLC electrically monitors all level switches, valve positions, and fluid meters.

In operation, hydrocarbon fuel enters through inlet 14 and flows through conduit 30 to blend tank 12. The flow of the hydrocarbon fuel is controlled by the PLC that monitors and controls the flow of the hydrocarbon fuel by monitoring and controlling pump 38, solenoid valve 40, and flow meter and totalizer 42.

The chemical additive is transferred from chemical additive storage tank 16 to blend tank 12 through conduit 50. The flow of chemical additive through conduit 50 is controlled by pump 60, solenoid valve 62, and flow meter and totalizer 64 that are monitored and controlled by the PLC.

Water is transferred from the water storage tank 18 to connecting tee 71 through conduit 70. The flow of water from water storage tank 18 to the connecting tee 71 is controlled by pump 76, solenoid valve 78, and flow meter and totalizer 80, that are monitored and controlled by the PLC.

The antifreeze agent is used when the process is conducted in an environment where the water may freeze. When used the antifreeze agent is transferred from antifreeze storage tank 20 to connecting tee 71 through conduit 90. The flow of the antifreeze agent through conduit 90 is controlled by pump 98, solenoid valve 100, and flow meter and totalizer 102, that are monitored and controlled by the PLC.

The hydrocarbon fuel and the chemical additive are mixed in blend tank 12. The resulting hydrocarbon fuel-additive mixture is transferred from blend tank 12 to connecting tee 110 through conduit 116. The flow of hydrocarbon fuel-additive mixture from blend tank 12 is controlled by actuated valve 118 that is controlled by the PLC. Water flows from connecting tee 71 to connecting tee 110 through conduit 108. The antifreeze agent, when used, mixes with the water in connecting tee 71 and the resulting mixture of antifreeze agent and water flows to connecting 110. In connecting tee 110, the hydrocarbon fuel-additive mixture is mixed with the water and, if used, the antifreeze agent. Connecting tee 110 is located at the entrance to high shear mixer 10. The mixture of hydrocarbon fuel-additive and water, and optionally antifreeze agent, is then transferred to high shear mixer 10 wherein it is subjected to high shear mixing.

In one embodiment, the initial mixing of the hydrocarbon fuel-additive mixture and water (and optionally antifreeze agent) during step (B) of inventive process occurs in the high shear mixer 10 or at the inlet to high shear mixer 10. In one embodiment, high shear mixing is commenced up to about 15 seconds after such initial mixing, and in one embodiment about 2 to about 15 seconds, and in one embodiment about 5 to about 10 seconds after such initial mixing.

The high shear mixing of the hydrocarbon fuel-additive mixture and water (and optionally antifreeze agent) results in the formation of the desired aqueous hydrocarbon fuel composition. A critical feature of the invention is that the water phase of the aqueous hydrocarbon fuel composition is comprised of droplets having a mean diameter of 1.0 micron or less. Thus, the high shear mixing is conducted under sufficient conditions to provide such a droplet size. In one embodiment, the mean droplet size is less than about 0.95 micron, and in one embodiment less than about 0.8 micron, and in one embodiment less than about 0.7 micron. In a preferred embodiment, the mean droplet size is in the range of about 0.01 to about 0.95 micron, more preferably about 0.01 to about 0.8 micron, more preferably about 0.01 to about 0.7 micron. In an especially preferred embodiment, the droplet size is in the range of about 0.1 to about 0.7 micron.

The aqueous hydrocarbon fuel composition can be recycled through conduits 130, 116 and 112, and tank 12 in order to obtain the desired droplet size. This recycling is controlled by actuated valves 118, 126 and 132 that are controlled by the PLC. In one embodiment, the aqueous hydrocarbon fuel composition is recycled 1 to about 35 times, and in one embodiment 1 to about 10 times, and in one embodiment 1 to about 5 times.

When the desired droplet size is achieved, the aqueous hydrocarbon fuel composition is stored in aqueous hydrocarbon fuel composition storage tank 22. The aqueous hydrocarbon fuel composition that is stored in storage tank 22 is a stable emulsion that, in one embodiment, can remain stable for at least about 90 days at a temperature of 25° C., and in one embodiment at least about 60 days, and in one embodiment at least about 30 days. The aqueous hydrocarbon fuel composition may be dispensed from storage tank 22 through dispenser 24. The aqueous hydrocarbon fuel composition flows from storage tank 22 to dispenser 24 through conduit 140. The flow of the aqueous hydrocarbon fuel composition through conduit 140 is controlled by pump 142.

The chemical additive storage tank 16 has a low-level alarm switch 190 incorporated into it. When the level in the tank 16 drops below the low-level switch, a low-level alarm is activated. The batch in progress when the low-level alarm condition occurs is permitted to finish. This is possible because sufficient volume exists below the level of the switch to do a complete batch. Further batch blending is prevented until the low level is corrected and the alarm is reset.

When chemical additive is called for in the blending process, pump 60 is started. This pump, that in one embodiment is a centrifugal pump, supplies chemical additive to the blend tank 12. If the pump fails to start or if its starter overload circuit trips, an alarm signal is sent to the PLC. The PLC shuts down the batch in progress and activates an alarm. Further operation is prevented until the fault is corrected.

In one embodiment, the flow meter of the flow meter and totalizer 64 is an oval gear meter with high resolution. An electronic pulse pickup is utilized to read revolutions of the meter. The meter provides better than one electrical pulse per milliliter. An electronic factoring totalizer accumulates pulses generated by the meter. Calibrated during initial setup, the totalizer resolves the volumetric pulses into hundreds of gallons of chemical additive delivered. With each one hundred of a gallon of flow, an electrical pulse is transmitted to the PLC. Based upon this flow the totalizer counts up to a target volume of chemical additive and then turns off the chemical additive flow.

Solenoid valve 62 controls the chemical additive flow. The PLC actuates this valve when additive flow is needed. Strainer 58 in conduit 50 prevents any solid contaminates from damaging the flow meter and totalizer 64. Valve 69, that may be a manually operated ball valve, is used to isolate the chemical additive during calibration and to throttle the flow of chemical additive. Valve 66, which may be a manually operated ball valve, is used to isolate a calibration tap. This tap is utilized to catch a volumetric sample during calibration of the totalizer of the flow meter and totalizer 64.

The antifreeze agent storage tank 20 has a low-level alarm switch 192 incorporated into it. When the level in the storage tank 20 drops below the low-level switch, a low-level alarm is activated. The batch in progress when the low-level alarm condition occurs is permitted to complete. This is possible because sufficient volume exists below the level of the switch to do a complete batch. Further batch blending is prevented until the low level is corrected and the alarm is reset.

When antifreeze agent is called for in the blending process, pump 98 is started. Pump 98, that in one embodiment is a centrifugal pump, supplies antifreeze agent to connecting tee 71 where the antifreeze agent mixes with water from conduit 70. If pump 98 fails to start or if its starter overload circuit trips, an alarm signal is sent to the PLC. The PLC shuts down the batch in progress and activates an alarm. Further batch blending is prevented until the fault is corrected and the alarm is reset.

In one embodiment, the flow meter of flow meter and totalizer 102 is an oval gear meter with high resolution. An electronic pulse pickup is utilized to read revolutions of the meter. The meter provides better than one electrical pulse per milliliter. The totalizer, that is an electronic factoring totalizer, accumulates pulses generated by the meter. Calibrated during initial setup, the totalizer resolves the volumetric pulses into hundredths of gallons of antifreeze agent delivered. With each one hundredth of a gallon of flow, an electrical pulse is transmitted to the PLC. Based upon this flow the totalizer counts up to a target volume of antifreeze agent and turns off the antifreeze agent flow.

Solenoid valve 100 controls the antifreeze agent flow. The PLC actuates this valve when the antifreeze agent flow is needed. Strainer 96 in conduit 90 prevents any solid contaminates from damaging flow meter and totalizer 102. Valve 106, that may be a manually operated ball valve, is used to isolate the antifreeze agent during calibration and to throttle flow of the antifreeze agent during normal operation. Valve 103, that may be a manually operated ball valve, is used to isolate a calibration tap. This tap is utilized to catch a volumetric sample during the calibration of the flow meter and totalizer 102.

In one embodiment, the water is deionized. For smaller volume demand systems water may be taken from a municipal supply and passed through a deionizing unit 86 and then into storage tank 18. For high capacity systems, larger deionizing units may be used, or bulk delivery of water may be used. In one embodiment, water storage tank 18 is a 550-gallon maximum fill, stainless steel tote, or a similarly sized polymeric material tank.

The water storage tank 18 has a low-level alarm switch 194 incorporated into it. When the level in the water storage tank 18 drops below the low-level switch, a low-level alarm is activated. The batch in progress when the low-level alarm condition occurs is permitted to complete. This is possible because sufficient volume exists below the level of the switch to do a complete batch. Further batch blending is prevented until the low level is corrected and the alarm, is reset.

The water storage tank 18 also has a high-level float switch in it. This switch is used in conjunction with a solenoid valve in the water supply line tank 18 to automatically control re-filling of the water storage tank 18.

When water is called for in the blending process, pump 76 is started. Pump 76, which may be a centrifugal pump, supplies water to connecting tee 71 where the water mixes with the antifreeze agent when an antifreeze agent is used. If the pump 76 fails to start or if its starter overload circuit trips, an alarm signal is sent to the PLC. The PLC shuts down the batch in progress and activates an alarm. Further batch blending is prevented until the fault is corrected and the alarm is reset.

In one embodiment, the flow meter of the flow meter and totalizer 80 is an oval gear meter with moderately high resolution. An electronic pulse pickup is utilized to read revolutions of the meter. The meter can provide approximately 760 pulses per gallon of water passing through it. The totalizer is an electronic factoring totalizer that accumulates pulses generated by the meter. Calibrated during initial setup, the totalizer resolves the volumetric pulses into tenths of gallons of water delivered. With each one tenth of a gallon of flow, an electrical pulse is transmitted to the PLC. Based upon this flow the PLC counts up to a target volume of water and turns off water flow.

Solenoid valve 78 controls the water flow. The PLC actuates this valve when. water is needed. Strainer 74 in conduit 70 prevents any solid contaminates from damaging the flow meter and totalizer 80. Valve 83, that may be a manually operated ball valve, is used to isolate the water during calibration and to throttle flow of the water components during normal operation. Valve 81, that may be a manually operated ball valve, isolates a calibration tap. This tap is utilized to catch a volumetric sample during the calibration of the totalizer of flow meter and totalizer 80.

When fuel is called for in the blending process, pump 38 is started. This pump, that may be a centrifugal pump, supplies fuel to blend tank 12 through conduit 30. If the pump fails to start or if its starter overload circuit trips, an alarm signal is sent to the PLC. The PLC shuts down the batch in progress and activates an alarm. Further batch blending is prevented until the fault is corrected and the alarm is reset.

In one embodiment, the flow meter of the flow meter and totalizer 42 is an oval gear meter with moderately high resolution. An electronic pulse pickup is utilized to read revolutions of the meter. The meter can provide approximately 135 pulses per gallon of fuel passing through it. The totalizer, that can be an electronic factoring totalizer, accumulates pulses generated by the meter. Calibrated during initial setup, the totalizer resolves the volumetric pulses into tenths of gallons of fuel delivered. With each one-tenth of a gallon of flow, an electrical pulse is transmitted to the PLC. Based upon this flow the controller counts up to a target volume of fuel and turns off fuel flow.

Solenoid valve 40 controls fuel flow. The PLC actuates this valve when fuel is needed in the blend. Strainer 36 in conduit 30 prevents any solid contaminates from damaging the flow meter and totalizer 42. Valve 48, that may be a manually operated ball valve, is used to isolate the fuel during calibration and to throttle the flow of the fuel during normal operation. Valve 44, that may be a manually operated ball valve, is used to isolate a calibration tap. This tap is utilized to catch a volumetric sample during the calibration of the totalizer.

Blend tank 12, which in one embodiment may be a vertically oriented cylindrical steel tank, is used as a mixing vessel. In one embodiment, this tank has a capacity of approximately 130 gallons. This tank may be equipped with two liquid level float switches 196 and 197. The high-level switch 196 is used to warn the PLC if the tank 12 has been overfilled during the blending process. This may occur if a flow meter fails. The low-level switch 197 is used by the PLC to shut off high-shear mixer 10. Blend tank 12 includes conduit 198 and valve 199 that are used for draining the contents of tank 12.

The high-shear mixer 10 may be a rotor-stator mixer, an ultrasonic mixer or a high-pressure homogenizer. The rotor-stator mixer may be comprised of a first rotor-stator and a second rotor-stator arranged in series. The hydrocarbon fuel-additive mixture and water are mixed in the first rotor-stator and then the second rotor-stator to form the desired aqueous hydrocarbon fuel composition. In one embodiment, a third rotor-stator is arranged in series with the first rotor-stator and said second rotor-stator. The hydrocarbon fuel-additive mixture and water advance through the first rotor-stator, then through the second rotor-stator, and then through the third rotor-stator to form the aqueous hydrocarbon fuel composition.

Figure 4A:
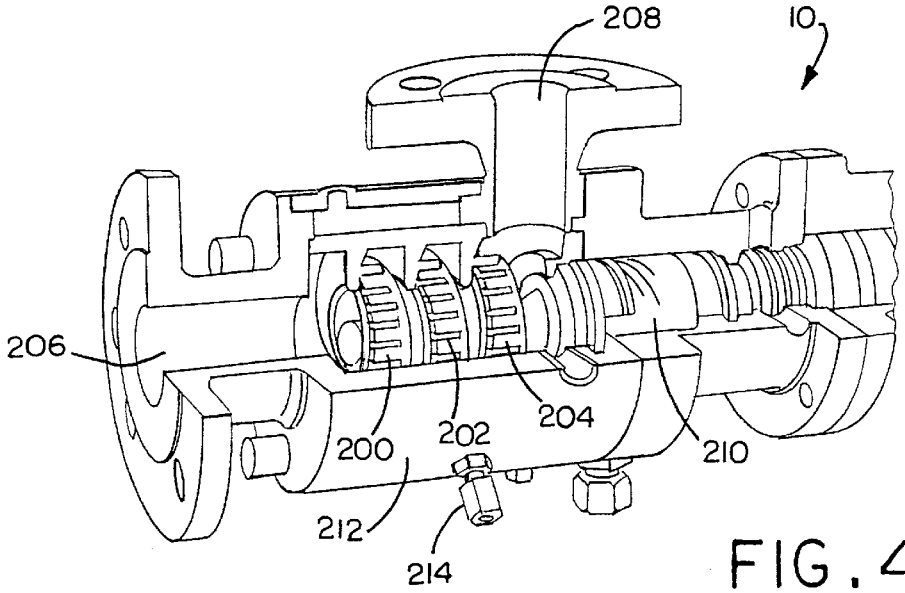
FIG. 4A is a partial cut away view of one embodiment of the high shear mixer provided for in accordance with the invention, this high shear mixer being a rotor-stator mixer having three rotor-stators arranged in series.
Figure 4B:
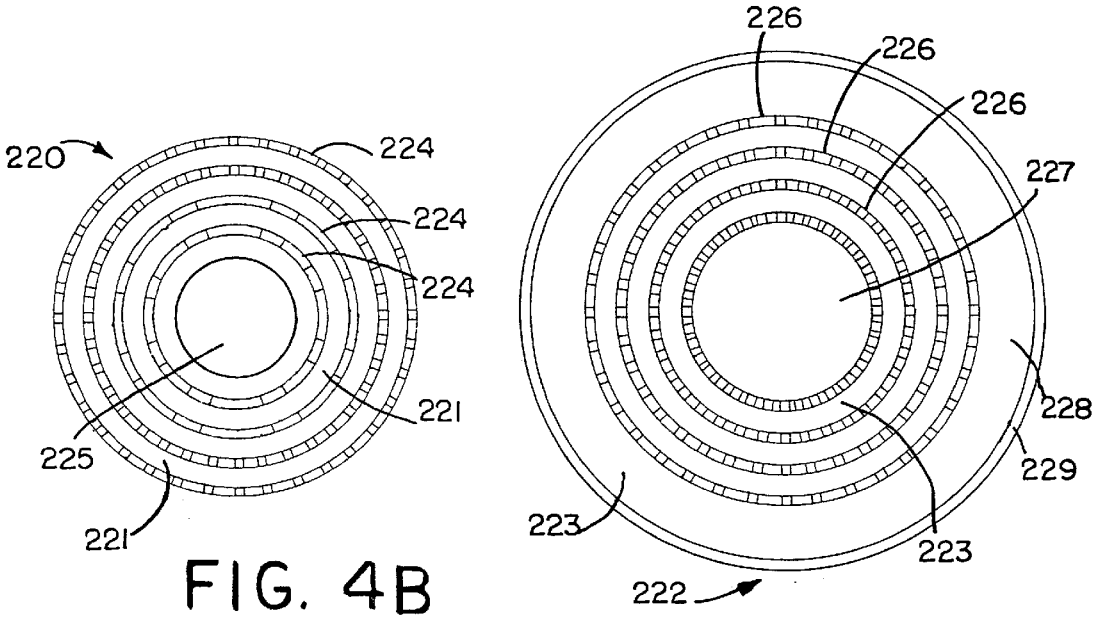
FIG. 4B is an enlarged plan view showing the interior of one of the rotors and one of the stators illustrated in FIG. 4A.

In one embodiment, high-shear mixer 10 is an in-line rotor-stator mixer of the type illustrated in FIG. 4A. This mixer includes rotor-stators 200, 202 and 204 arranged in series. Mixer 10 has an inlet 206, an outlet 208, a mechanical seal 210, a heating or cooling jacket 212, and an inlet 214 to the heating or cooling jacket 212. Each of the rotor-stators has a rotor mounted coaxially within a stator. The rotors are rotated by a motor that is not shown in FIG. 4A but if shown would be located to the right (in FIG. 4A) of mechanical seal 210. The rotor-stators 200, 202 and 204 may have the same design or each may be different. In the embodiment disclosed in FIG. 4A each has the same design. The rotor 220 and the stator 222 for rotor-stator 200 (or 202 or 204) are shown in FIG. 4B. Rotor 220 and stator 222 have multi-rowed arrays of teeth 224 and 226 arranged in concentric circles projecting from circular disks 221 and 223, respectively. Rotor 220 has an interior opening 225. Stator 222 has an interior opening 227 and an annular space 228 defined by circular disk 223 and projecting cylindrical wall 229. Cylindrical wall 229 does not project as high as teeth 226. Rotor 220 and stator 222 are dimensioned so that the rotor 220 fits inside the stator 222 with the rotor teeth 224 and the stator teeth 226 being interleaved. The grooves between the teeth 224 and 226 may be radial or angled, continuous or interrupted. The teeth 224 and 226 may have triangular, square, round, rectangular or other suitable profiles, with square and rectangular being particularly useful. The rotor 220 rotates at a speed of up to about 10,000 rpm, and in one embodiment about 1000 to about 10,000 rpm, and in one embodiment about 4000 to about 5500 rpm, relative to the stator 222 that is stationary. The tangential velocity or tip speed of rotor 220 ranges from about 3000 to about 15,000 feet per minute, and in one embodiment about 4500 to about 5400 feet per minute. The rotation of the rotor 220 draws the mixture of hydrocarbon fuel-additive mixture and water (and optionally antifreeze agent) axially through inlet 206 into the center opening of rotor-stator 200, defined by opening 225, and disperses the mixture radially through the concentric circles of teeth 224 and 226 and then out of rotor-stator 200. The mixture is then drawn through the center opening of rotor-stator 202 and dispersed radially outwardly through the concentric circles of teeth in rotor-stator 202 and then out of rotor-stator 202. The mixture is then drawn through the center opening of rotor-stator 204 and dispersed radially outwardly through the concentric circles of teeth in rotor-stator 204 and then out of rotor-stator 204 to outlet 208. The mixture that is advanced through the rotor-stators 200, 202 and 204 is subjected to high-speed mechanical and hydraulic shearing forces resulting in the formation of the desired aqueous hydrocarbon fuel composition. In one embodiment, the mixer 10 is a Dispax-Reactor Model DR3 equipped with Ultra-Turrax UTL-T./8 rotor-stators supplied by IKA-Maschinenbau.

As indicated above, the high-shear mixer 10 can be an ultrasonic mixer.

In this mixer a liquid mixture of hydrocarbon fuel-additive mixture and water (and optionally antifreeze agent) is forced under high pressure (e.g., about 2000 to about 10,000 psig, and in one embodiment about 4000 to about 600 psig) through an orifice at a high velocity (e.g., about 100 to about 400 feet per second (fps), and in one embodiment about 150 to about 300 fps), and directed at the edge of a blade-like obstacle in its path. Between the orifice and blade-like obstacle, the liquid mixture sheds vortices perpendicular to the original flow vector. The shedding pattern alternates such that a steady oscillation, in the sonic range, occurs within the liquid mixture. The stresses set up within the liquid mixture by sonic oscillations cause the liquid mixture to cavitate in the ultrasonic frequency range. Examples of ultrasonic mixers that can be used include Triplex Sonilator Models XS-1500 and XS-2100 that are available from Sonic Corporation.

The high-shear mixer 10 may be a high-pressure homogenizer. In such a mixer a mixture of the hydrocarbon fuel-additive mixture and water (and optionally antifreeze agent) is forced under high pressure (e.g., about 10,000 to about 40,000 psig) through a small orifice (e.g., about ¼ inch to about ¾ inch in diameter) to provide the desired mixing. An example of a useful homogenizer is available from Microfluidics International Corporation under the tradename Microfluidizer.

The aqueous hydrocarbon fuel storage tank 22, in one embodiment, is a 550-gallon stainless steel tote tank. This tank may have a normal maximum fill of 500 gallons, permitting room for thermal expansion of the blend if needed.

Three float-type level detection switches 240, 242 and 244 may be installed in tank 22. Switch 240, that is a high-level alarm switch guarantees that a shutdown and alarm shall occur if the storage tank level becomes abnormally high. Switch 242, that is a batch initiate level switch, may be positioned, for example, at the 400-gallon level in the tank. When the amount of the aqueous hydrocarbon fuel composition drops to this level in the tank, the controller may be sent a signal that initiates the blending of a 100-gallon makeup batch. Finally, switch 244 is a low-level switch located near the bottom of the tank. If the aqueous hydrocarbon fuel composition reaches this level, the pump 142 is prevented from running.

The dispenser pump 142 may be located on top of the aqueous hydrocarbon fuel storage tank 22. This pump, that in one embodiment may be a thirty-gallon-per-minute pump, supplies fuel to the dispenser 24. Pump 142 maybe started by a nozzle stow switch located on dispenser 24. Should a low-level alarm occur in tank 22, pump 142 is locked off by the PLC.

Dispenser 24 may be a high capacity unit specifically designed for fleet fueling applications. The dispenser is placed in a position that facilitates vehicular traffic past it. The dispenser may have a manually resettable totalizer on it for indicating the total fuel dispensed into a vehicle. A one-inch hose (e.g., 30 feet in length) may be stored on a reel attached to the dispenser and used to dispense the fuel. An automatic shutoff nozzle may be used.

In one embodiment, the PLC is an Allen-Bradley SLC503 programmable logic controller. A communications adapter can be installed into the unit to allow it to be remotely accessed. The adapter can be an Allen-Bradley model 1747-KE module. To interface the communications adapter to a standard telephone line, an asynchronous personal computer (PC) modem may be used.

Figure 5:
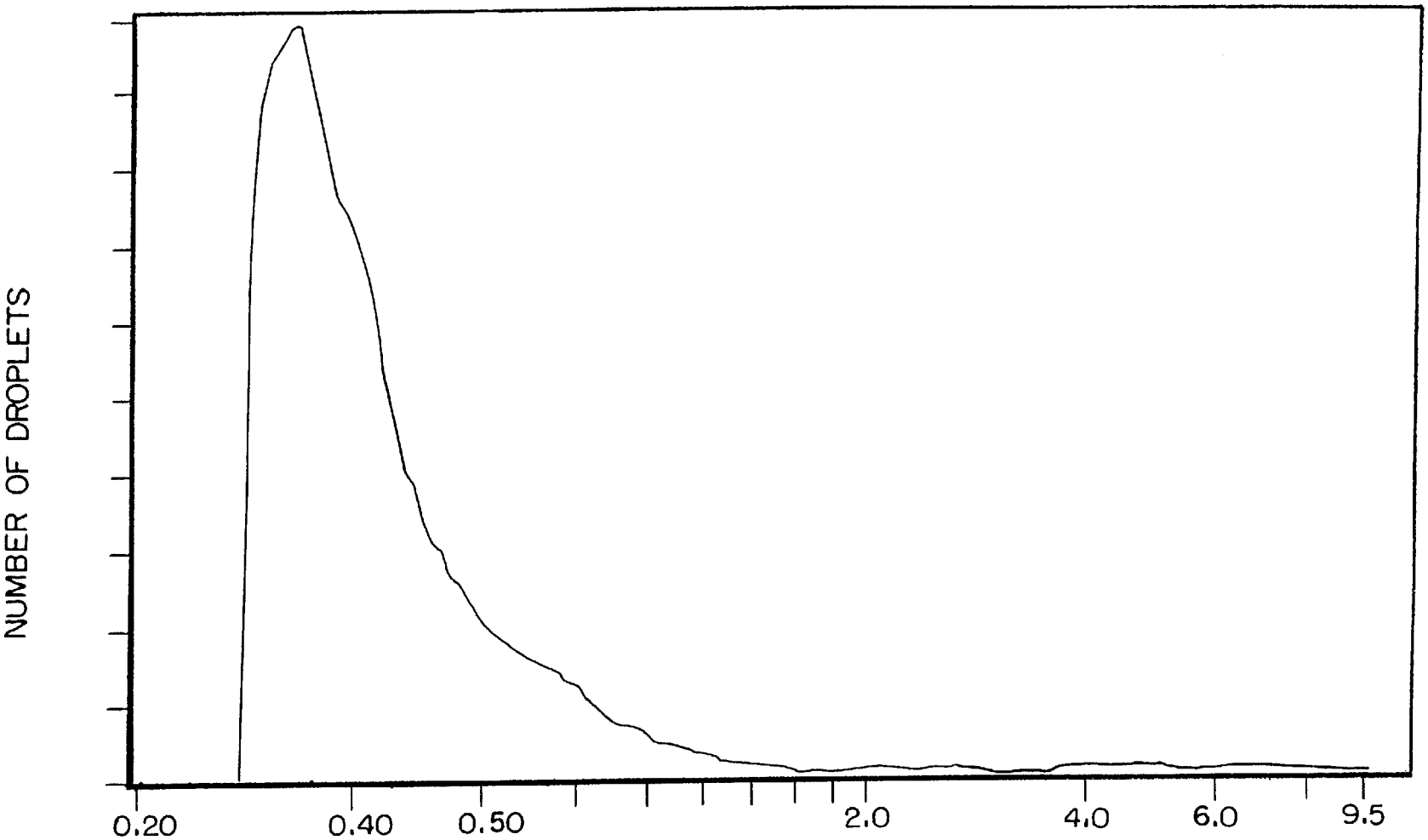
FIG. 5 is a plot of the number of aqueous phase droplets verses droplet diameter determined for the aqueous hydrocarbon fuel composition (formulation A) produced in the Example.

The process can be programmed and monitored on site or from a remote location using personal desktop computers. In this regard, multiple blending operations or units can be programmed and monitored from a remote location. This is illustrated in FIG. 5 where PC1 (personal computer No. 1) monitors the operation of N blending units (Unit 1, Unit 2. Unit N) and PC2 (personal computer No. 2) is used to program the operation of each blending unit. PC1 can be operated using Rockwell Software RSsql. PC2 can be operated using Rockwell Software RSlogix. PC1 and PC2 communicate with the PLC of each blending unit through phone lines using a card/modem. PC1 and PC2 may be run on Windows NT operating systems.

During operation, a record can be made for each of the aqueous hydrocarbon fuel compositions that are produced using PC1. This record may include the amount of each blend component used, the date and time the blend was completed, a unique batch identification number, and any alarms that may have occurred during the batch. In addition to the batch records, two running grand totals can be produced. One is the total amount of additive used in the batches and the other is the total aqueous hydrocarbon fuel composition produced. These two numbers can be used to reconcile against the batch totals to verify production.

Access of data may be begun automatically with PC1. On a preprogrammed interval, PC1 dials the telephone number of the blending unit. The blending unit modem answers the incoming call and links the PC1 to the blending unit. Data requested by PC1 is automatically transferred from the blending unit to PC1 via the telephone link. PC1 then disconnects the remote link. The data retrieved is transferred into an SQL (structured query language) compliant database in PC1. The data can then be viewed or reports generated using a number of commonly available software programs (e.g., Access or Excel from Microsoft, or SAP R/3 from SAP AG).

The operating parameters of the process (e.g., high-shear mixing time, amount of each component used per batch, etc.) are controlled by the PLC. The PLC can be programmed by PC2. These parameters can be changed using PC2.

Figure 2:
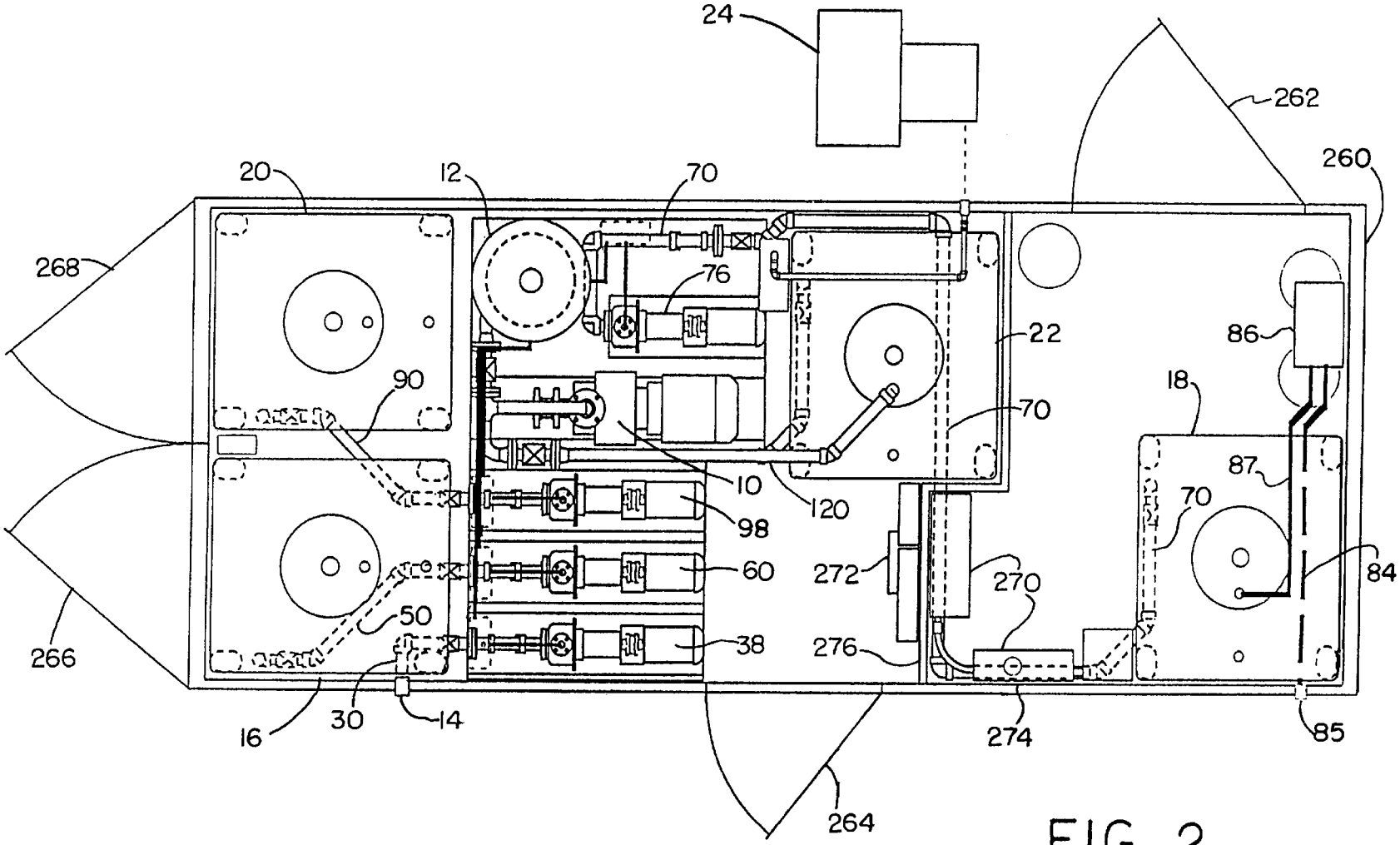
FIG. 2 is an overhead plan view illustrating one embodiment of the inventive apparatus that is in the form of a containerized equipment package or unit.
Figure 3:
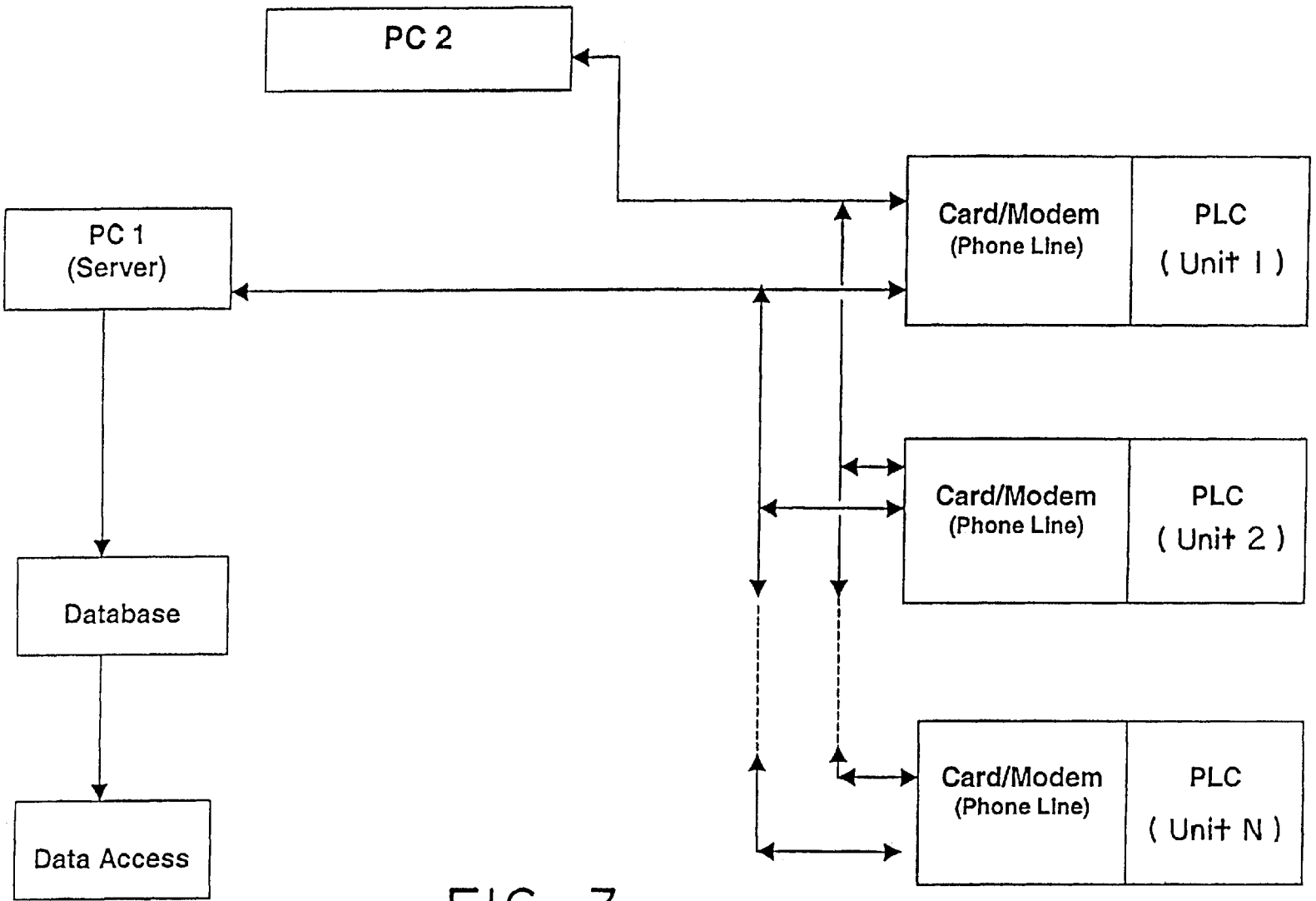
FIG. 3 is a flow sheet illustrating the electronic communication between a plurality of programmable logic controllers associated with corresponding apparatus for operating the inventive process, the programmable logic controllers being located remotely from a programming computer communicating with such programmable logic controllers and a monitoring computer communicating with such programmable logic controllers.

In one embodiment, the inventive apparatus is in the form of containerized equipment package or unit of the type illustrated in FIG. 2. Referring to FIG. 2, the apparatus is housed within an elongated rectangular housing 260 that has access doors 262, 264, 266 and 268. The housing can be mounted on wheels to provide it with mobility for travel from one user's location to another, or it can be permanently mounted at one user's location. Within the housing 260, chemical additive storage tank 16 and antifreeze agent storage tank 20 are mounted next to each other adjacent the left-side wall (as viewed in FIG. 2) of housing 260. Blending tank 12 is mounted next to chemical additive storage tank. Pumps 38, 60 and 98, and high-shear mixer 10 are aligned side-by-side next to tanks 16 and 20. Pump 76 is mounted next to blend tank 12. Aqueous hydrocarbon fuel composition storage tank 22 is mounted next to high shear mixer 10 and pump 76. Water storage tank 18 and deionizer 86 are mounted next to each other adjacent the right-side wall (as viewed in FIG. 2) of housing 260. Electrical controls 270 for the PLC and a display 272 for the PLC are mounted on housing walls 274 and 276. Dispenser 24 is mounted exterior to the housing 260. The interconnections of the components of assembly and their operation are as described above.

The Aqueous Hydrocarbon Fuel Compositions

The aqueous hydrocarbon fuel compositions of the invention will now be described. These fuel compositions may be prepared in accordance with the foregoing process using the apparatus described above. The water used in forming these compositions can be from any convenient source. In one embodiment, the water is deionized prior to being mixed with the normally liquid hydrocarbon fuel and chemical additives. In one embodiment, the water is purified using reverse osmosis or distillation.

The water is present in the aqueous hydrocarbon fuel compositions of the invention at a concentration of about 5 to about 40% by weight, and in one embodiment about 10 to about 30% being weight, and in one embodiment about 15 to about 25% by weight.

The Normally Liquid Hydrocarbon Fuel

The normally liquid hydrocarbon fuel may be a hydrocarbonaceous petroleum distillate fuel such as motor gasoline as defined by ASTM Specification D439 or diesel fuel or fuel oil as defined by ASTM Specification D396. Normally liquid hydrocarbon fuels comprising non-hydrocarbonaceous materials such as alcohols, ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid hydrocarbon fuels that are mixtures of one or more hydrocarbonaceous fuels and one or more non-hydrocarbonaceous materials are also contemplated. Examples of such mixtures are combinations of gasoline and ethanol and of diesel fuel and ether.

In one embodiment, the normally liquid hydrocarbon fuel is gasoline, that is, a mixture of hydrocarbons having an ASTM distillation range from about 60° C. at the 10% distillation point to about 205° C. at the 90% distillation point. In one embodiment, the gasoline is a chlorine-free or low-chlorine gasoline characterized by a chlorine content of no more than about 10 ppm.

The diesel fuels that are useful with this invention can be any diesel fuel. These diesel fuels typically have a 90% point distillation temperature in the range of about 300° C. to about 390° C., and in one embodiment about 330° C. to about 350° C. The viscosity for these fuels typically ranges from about 1.3 to about 24 centistokes at 40° C. The diesel fuels can be classified as any of Grade Nos. 1-D, 2-D or 4-D as specified in ASTM D975. These diesel fuels may contain alcohols and esters. In one embodiment the diesel fuel has a sulfur content of up to about 0.05% by weight (low-sulfur diesel fuel) as determined by the test method specified in ASTM D2622-87. In one embodiment, the diesel fuel is a chlorine-free or low-chlorine diesel fuel characterized by a chlorine content of no more than about 10 ppm.

The normally liquid hydrocarbon fuel is present in the aqueous hydrocarbon fuel compositions of the invention at a concentration of about 50 to about 95% by weight, and in one embodiment about 60 to about 95% by weight, and in one embodiment about 65 to about 85% by weight, and in one embodiment about 70 to about 80% by weight.

The Chemical Additives

In one embodiment, the chemical additive used in accordance with the invention is an emulsifier composition that comprises: (i) a hydrocarbon fuel-soluble product made by reacting a hydrocarbyl-substituted carboxylic acid acylating agent with ammonia or an amine, the hydrocarbyl substituent of said acylating agent having about 50 to about 500 carbon atoms; (ii) an ionic or a nonionic compound having a hydrophilic lipophilic balance (HLB) of about 1 to about 10; or a mixture of (i) and (ii); in combination with (iii) a water-soluble salt distinct from (i) and (ii). Mixtures of (i), (ii) and (iii) are preferred. This emulsifier composition is present in the aqueous hydrocarbon fuel compositions of the invention at a concentration of about 0.05 to about 20% by weight, and in one embodiment about 0.05 to about 10% by weight, and in one embodiment about 0.1 to about 5% by weight, and in one embodiment about 0.1 to about 3% by weight, and in one embodiment about 0.1 to about 2.5% by weight.

In a preferred embodiment, component (i) is a combination of (i)(a) at least one reaction product of an acylating agent with an alkanol amine and (i)(b) at least one reaction product of an acylating agent with at least one ethylene polyamine. This preferred embodiment is discussed in more detail in The Hydrocarbon Fuel-Soluble Product (i) section below.

The Hydrocarbon Fuel-Soluble Product (i)

The hydrocarbyl-substituted carboxylic acid acylating agent for the hydrocarbon fuel-soluble product (i) may be a carboxylic acid or a reactive equivalent of such acid. The reactive equivalent may be an acid halide, anhydride, or ester, including partial esters and the like. The hydrocarbyl substituent for the carboxylic acid acylating agent may contain from about 50 to about 300 carbon atoms, and in one embodiment about 60 to about 200 carbon atoms. In one embodiment, the hydrocarbyl substituent of the acylating agent has a number average molecular weight of about 750 to about 3000, and in one embodiment about 900 to about 2000.

In one embodiment, the hydrocarbyl-substituted carboxylic acid acylating agent for the hydrocarbon fuel soluble product (i) may be made by reacting one or more alpha-beta olefinically unsaturated carboxylic acid reagents containing 2 to about 20 carbon atoms, exclusive of the carboxyl groups, with one or more olefin polymers as described more fully hereinafter.

The alpha-beta olefinically unsaturated carboxylic acid reagents may be either monobasic or polybasic in nature. Exemplary of the monobasic alpha-beta olefinically unsaturated carboxylic acid include the carboxylic acids corresponding to the formula:

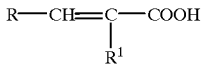

wherein R is hydrogen, or a saturated aliphatic or alicyclic, aryl, alkylaryl or heterocyclic group, preferably hydrogen or a lower alkyl group, and $R^1$ is hydrogen or a lower alkyl group. The total number of carbon atoms in R and $R^1$ typically does not exceed about 18 carbon atoms. Specific examples of useful monobasic alpha-beta olefinically unsaturated carboxylic acids include acrylic acid; methacrylic acid; cinnamic acid; crotonic acid; 3-phenyl propenoic acid; alpha, and beta-decenoic acid. The polybasic acid reagents are preferably dicarboxylic, although tri- and tetracarboxylic acids can be used. Exemplary polybasic acids include maleic acid, fumaric acid, mesaconic acid, itaconic acid and citraconic acid. Reactive equivalents of the alpha-beta olefinically unsaturated carboxylic acid reagents include the anhydride, ester or amide functional derivatives of the foregoing acids. A preferred reactive equivalent is maleic anhydride.

The olefin monomers from that the olefin polymers may be derived are polymerizable olefin monomers characterized by having one or more ethylenic unsaturated groups. They can be monoolefinic monomers such as ethylene, propylene, butene-1, isobutene and octene-1 or polyolefinic monomers (usually di-olefinic monomers such as butadiene-1,3 and isoprene). Usually these monomers are terminal olefins, that is, olefins characterized by the presence of the group>C═$CH_2$. However, certain internal olefins can also serve as monomers (these are sometimes referred to as medial olefins). When such medial olefin monomers are used, they normally are employed in combination with terminal olefins to produce olefin polymers that are interpolymers. Although, the olefin polymers may also include aromatic groups (especially phenyl groups and lower alkyl and/or lower alkoxy-substituted phenyl groups such as para (tertiary-butyl)-phenyl groups) and alicyclic groups such as would be obtained from polymerizable cyclic olefins or alicyclic-substituted polymerizable cyclic olefins, the olefin polymers are usually free from such groups. Nevertheless, olefin polymers derived from such interpolymers of both 1,3-dienes and styrenes such as butadiene-1,3 and styrene or para-(tertiary butyl) styrene are exceptions to this general rule.

Generally the olefin polymers are homo- or interpolymers of terminal hydrocarbyl olefins of about 2 to about 30 carbon atoms, and in one embodiment about 2 to about 16 carbon atoms. A more typical class of olefin polymers is selected from that group consisting of homo- and interpolymers of terminal olefins of 2 to about 6 carbon atoms, and in one embodiment 2 to about 4 carbon atoms.

Specific examples of terminal and medial olefin monomers that can be used to prepare the olefin polymers include ethylene, propylene, butene-1, butene-2, isobutene, pentene-1, hexene-1, heptene-1, octene-1, nonene-1, decene-1, pentene-2, propylene tetramer, diisobutylene, isobutylene trimer, butadiene-1,2, butadiene-1,3, pentadiene-1,2, pentadiene-1,3, isoprene, hexadiene-1,5, 2-chlorobutadiene-1,3, 2-methylheptene-1, 3-cyclohexylbutene-1, 3,3-dimethylpentene-1, styrene divinylbenzene, vinyl-acetate allyl alcohol, 1-methylvinylacetate, acrylonitrile, ethyl acrylate, ethylvinylether and methylvinylketone. Of these, the purely hydrocarbon monomers are more typical and the terminal olefin monomers are especially useful.

In one embodiment, the olefin polymers are polyisobutylenes such as those obtained by polymerization of a $C_4$ refinery stream having a butene content of about 35 to about 75% by weight and an isobutene content of about 30 to about 60% by weight in the presence of a Lewis acid catalyst such as aluminum chloride or boron trifluoride. These polyisobutylenes generally contain predominantly (that is, greater than about 50 percent of the total repeat units) isobutene repeat units of the configuration:

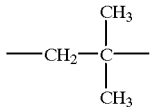

In one embodiment, the olefin polymer is a polyisobutene group (or polyisobutylene group) having a number average molecular weight of about 750 to about 3000, and in one embodiment about 900 to about 2000.

In one embodiment, the acylating agent for the hydrocarbon fuel-soluble product (i) is a hydrocarbyl-substituted succinic acid or anhydride represented correspondingly by the formulae

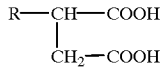

or

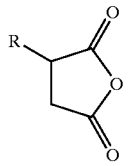

wherein R is hydrocarbyl group of about 50 to about 500 carbon atoms, and in one embodiment from about 50 to about 300, and in one embodiment from about 60 to about 200 carbon atoms. The production of these hydrocarbyl-substituted succinic acids or anhydrides via alkylation of maleic acid or anhydride or its derivatives with a halohydrocarbon or via reaction of maleic acid or anhydride with an olefin polymer having a terminal double bond is well known to those of skill in the art and need not be discussed in detail herein.

In one embodiment, the hydrocarbyl-substituted carboxylic acid acylating agent for the product hydrocarbon fuel-soluble product (i) is a hydrocarbyl-substituted succinic acylating agent consisting of hydrocarbyl substituent groups and succinic groups. The hydrocarbyl substituent groups are derived from an olefin polymer as discussed above. The hydrocarbyl-substituted carboxylic acid acylating agent is characterized by the presence within its structure of an average of at least 1.3 succinic groups, and in one embodiment from about 1.5 to about 2.5, and in one embodiment form about 1.7 to about 2.1 succinic groups for each equivalent weight of the hydrocarbyl substituent.

For purposes of this invention, the equivalent weight of the hydrocarbyl substituent group of the hydrocarbyl-substituted succinic acylating agent is deemed to be the number obtained by dividing the number average molecular weight ($M_n$) of the polyolefin from which the hydrocarbyl substituent is derived into the total weight of all the hydrocarbyl substituent groups present in the hydrocarbyl-substituted succinic acylating agents. Thus, if a hydrocarbyl-substituted acylating agent is characterized by a total weight of all hydrocarbyl substituents of 40,000 and the $M_n$ value for the polyolefin from which the hydrocarbyl substituent groups are derived is 2000, then that substituted succinic acylating agent is characterized by a total of 20 (40,000/2000=20) equivalent weights of substituent groups.

The ratio of succinic groups to equivalent of substituent groups present in the hydrocarbyl-substituted succinic acylating agent (also called the "succination ratio") can be determined by one skilled in the art using conventional techniques (such as from saponification or acid numbers). For example, the formula below can be used to calculate the succination ratio where maleic anhydride is used in the acylation process:

$$SR = \frac{M_n \times (\text{Sap. No. of acylating agent})}{(56100 \times 2) - (98 \times \text{Sap. No. of acylating agent})}$$

In this equation, SR is the succination ratio, $M_n$ is the number average molecular weight, and Sap. No. is the saponification number. In the above equation, Sap. No. of acylating agent=measured Sap. No. of the final reaction mixture/Al wherein Al is the active ingredient content expressed as a number between 0 and 1, but not equal to zero. Thus an active ingredient content of 80% corresponds to an Al value of 0.8. The Al value can be calculated by using techniques such as column chromatography that can be used to determine the amount of unreacted polyalkene in the final reaction mixture. As a rough approximation, the value of Al is determined after subtracting the percentage of unreacted polyalkene from 100.

The hydrocarbon fuel-soluble product (i) may be formed using ammonia and/or an amine. The amines useful for reacting with the acylating agent to form the product (i) include monoamines, polyamines, and mixtures thereof.

The monoamines have only one amine functionality whereas the polyamines have two or more. The amines may be primary, secondary or tertiary amines. The primary amines are characterized by the presence of at least one —$NH_2$ group; the secondary by the presence of at least one H—N< group. The tertiary amines are analogous to the primary and secondary amines with the exception that the hydrogen atoms in the —$NH_2$ or H—N< groups are replaced by hydrocarbyl groups. Examples of primary and secondary monoamines include ethylamine, diethylamine, n-butylamine, di-n-butylamine, allylamine, isobutylamine, cocoamine, stearylamine, laurylamine, methyllaurylamine, oleylamine, N-methyloctylamine, dodecylamine, and octadecylamine. Suitable examples of tertiary monoamines include trimethylamine, triethylamine, tripropyl amine, tributylamine, monomethyidimethylamine, monoethyldimethylamine, dimethylpropyl amine, dimethylbutyl amine, dimethylpentyl amine, dimethylhexyl amine, dimethylheptyl amine, and dimethyloctyl amine.

The amines may be hydroxyamines. The hydroxyamines may be primary, secondary or tertiary amines. Typically, the hydroxyamines are primary, secondary or tertiary alkanolamines. The alkanol amines may be represented by the formulae:

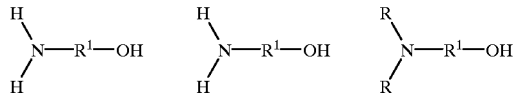

wherein in the above formulae each R is independently a hydrocarbyl group of 1 to about 8 carbon atoms, or a hydroxyl-substituted hydrocarbyl group of 2 to about 8 carbon atoms and each R' independently is a hydrocarbylene (i.e., a divalent hydrocarbon) group of 2 to about 18 carbon atoms. The group —R'—OH in such formulae represents the hydroxyl-substituted hydrocarbylene group. R' may be an acyclic, alicyclic, or aromatic group. In one embodiment, R' is an acyclic straight or branched alkylene group such as ethylene, 1,2-propylene, 1,2-butylene, 1,2-octadecylene, etc. group. When two R groups are present in the same molecule they may be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each R is independently a lower alkyl group of up to seven carbon atoms.

Suitable examples of the above hydroxyamines include mono-, di-, and triethanolamine, dimethylethanolamine, diethylethanolamine, di-(3-hydroxyl propyl) amine, N-(3-hydroxyl butyl) amine, N-(4-hydroxyl butyl) amine, and N,N-di-(2-hydroxyl propyl) amine.

The hydrocarbon fuel-soluble product (i) may be a salt, an ester, an amide, an imide, or a combination thereof. The salt may be an internal salt involving residues of a molecule of the acylating agent and the ammonia or amine wherein one of the carboxyl groups becomes ionically bound to a nitrogen atom within the same group; or it may be an external salt wherein the ionic. salt group is formed with a nitrogen atom that is not part of the same molecule. In one embodiment, the amine is a hydroxyamine, the hydrocarbyl-substituted carboxylic acid acylating agent is a hydrocarbyl-substituted succinic anhydride, and the resulting hydrocarbon fuel-soluble product (i) is a half ester and half salt, i.e., an ester/salt.

The reaction between the hydrocarbyl-substituted carboxylic acid acylating agent and the ammonia or amine is carried out under conditions that provide for the formation of the desired product. Typically, the hydrocarbyl-substituted carboxylic acid acylating agent and the ammonia or amine are mixed together and heated to a temperature in the range of from about 50° C. to about 250° C., and in one embodiment from about 80° C. to about 200° C.; optionally in the presence of a normally liquid, substantially inert organic liquid solvent/diluent, until the desired product has formed. In one embodiment, the hydrocarbyl substituted carboxylic acid acylating agent and the ammonia or amine are reacted in amounts sufficient to provide from about 0.3 to about 3 equivalents of hydrocarbyl substituted carboxylic acid acylating agent per equivalent of ammonia or amine. In one embodiment, this ratio is from about 0.5:1 to about 2:1, and in one embodiment about 1:1.

In one embodiment, the hydrocarbon fuel-soluble product (i) is made by reacting a polyisobutene-substituted succinic anhydride having an average of about 1 to about 3 succinic groups for each equivalent of polyisobutene group with diethanolamine or dimethylethanolamine in an equivalent ratio (i.e. carbonyl to amine ratio) of about 1 to about 0.4–1.25, and in one embodiment about 1:1. The polyisobutene group has a number average molecular weight of about 750 to about 3000, and in one embodiment about 900 to about 2000.

In a preferred embodiment, component (i) is a combination of (i)(a) at least one reaction product of an acylating agent with an alkanol amine and (i)(b) at least one reaction product of an acylating agent with at least one ethylene polyamine.

More specifically, in this preferred embodiment, component (i)(a) is a hydrocarbon fuel-soluble product made by reacting an acylating agent with alkanol amine, wherein said alkanol amine is preferably a dimethylethanol amine or a diethylethanolamine. Preferably, component (i)(a) is made from a polyisobutylene group having a number average molecular weight (Mn) range of from about 1500 to about 3000, and that is maleinated or succinated in the range from 1.3 up to 2.5.

Component (i)(b) is a hydrocarbon fuel-soluble product made by reacting an acylating agent with at least one ethylene polyamine such as TEPA (tetraethylenepentamine), PEHA (pentaethylenehexaamine), TETA (triethylenetetramine), polyamine bottoms, or at least one heavy polyamine. The ethylene polyamine can be condensed to form a succinimide, as exemplified in Example 3. The equivalent ratio of the reaction for CO:N is from 1:1.5 to 1:0.5, more preferably from 1:1.3 to 1:0.70, and most preferably from 1:1 to 1:0.70, wherein CO:N is the carbonyl to amine nitrogen ratio. Also, component (i)(b) is preferably made from a polyisobutylene group having a number average molecular weight of from about 700 to about 1300 and that is succinated in the range from 1.0 up to 1.3.

The polyamines useful in reacting with the acylating agent for component (i)(b) can be aliphatic, cycloaliphatic, heterocyclic or aromatic compounds. Especially useful are the alkylene polyamines represented by the formula:

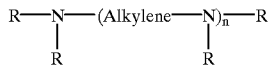

wherein n is from 1 to about 10, preferably from 1 to about 7; each R is independently a hydrogen atom, a hydrocarbyl group or a hydroxy-substituted hydrocarbyl group having up to about 700 carbon atoms, and in one embodiment up to about 100 carbon atoms, and in one embodiment up to about 50 carbon atoms, and in one embodiment up to about 30 carbon atoms; and the "Alkylene" group has from 1 to about 18 carbon atoms, and in one embodiment from 1 to about 6 carbon atoms.

Heavy polyamines typically result from stripping of polyamine mixtures, to remove lower molecular weight polyamines and volatile components, to leave, as residue, what is often termed "polyamine bottoms". In general, alkylene polyamine bottoms can be characterized as having less than 2%, usually less than 1% (by weight) material boiling below about 200° C. In the instance of ethylene polyamine bottoms, which are readily available and found to be quite useful, the bottoms contain less than about 2% (by weight) total diethylenetriamine (DETA) or triethylenetetramine (TETA), as set forth in U.S. Pat. No. 5,912,213, incorporated herein by reference in its entirety. A typical sample of such ethylene polyamine bottoms obtained from the Dow Chemical Company of Freeport, Tex., designated "E-100" has a specific gravity at 15.6° C. of 1.0168, a percent nitrogen by weight of 33.15 and a viscosity at 40° C. of 121 centistokes. Gas chromatography analysis of such a sample showed it contains about 0.93% "Light Ends" (most probably diethylenetriamine), 0.72% triethylene tetramine, 21.74% tetraethylenepentamine and 76.61% pentaethylenehexamine and higher (by weight). Another commercially available sample is from Union Carbide, known as HPA-X®. These alkylene polyamine bottoms include cyclic condensation products such as piperazine and higher analogs of diethylenetriamine, triethylenetetramine and the like.

The term "heavy polyamine" can also refer to a polyamine that contains 7 or more nitrogens per molecule, or polyamine oligomers containing 7 or more nitrogens per molecule and with 2 or more primary amines per molecule, for example, as set forth in European Patent No. EP 0770098, incorporated herein by reference in its entirety.

In another embodiment, both i(a) and i(b) can each made from a higher molecular weight polyisobutylene group (meaning Mn greater than or equal to about 1500, preferably from about 1500 to about 3000). In an alternative embodiment, components i(a) and i(b) can each made from a lower molecular weight polyisobutylene group (meaning $M_n$ less than or equal to about 1300, preferably from about 700 to 1300).

In another embodiment, component i(a) is made from a polyisobutylene group having a number average molecular weight range of from about 700 to about 1300, and component i(b) is made from a polyisobutylene group having a Mn range of from about 1500 to about 3000.

Preferably, component (i)(b) is made by reacting (a succinic acylating agent with a polyamine) at a sufficient temperature to remove water and form a succinimide.

Preferably, component (i)(b) is combined with component (i)(a) in an amount from about 0.05% to about 0.95% based upon the total weight of component (i).

In another embodiment, the hydrocarbon fuel-soluble product (i) is a salt composition comprised of (I) a first polycarboxylic acylating agent, said first polycarboxylic acylating agent having at least one hydrocarbyl substituent of about 20 to about 500 carbon atoms, (II) a second polycarboxylic acylating agent, said second polycarboxylic acylating agent optionally having at least one hydrocarbyl substituent of up to about 500 carbon atoms, said polycarboxylic acylating agents (I) and (II) being coupled together by a linking group (III) derived from a linking compound having two or more primary amino groups, two or more secondary amino groups, at least one primary amino group and at least one secondary amino group, at least two hydroxyl groups, or at least one primary or secondary amino group and at least one hydroxyl groups, said polycarboxylic acylating agents (I) and (II) forming a salt with (IV) ammonia or an amine.

The hydrocarbyl substituent of the first acylating agent (I) may have about 30 to about 500 carbon atoms, and in one embodiment about 40 to about 500 carbon atoms, and in one embodiment about 50 to about 500 carbon atoms.

The optional hydrocarbyl substituent of the second acylating agent (II) may have 1 to about 500 carbon atoms, and in one embodiment about 6 to about 500 carbon atoms, and in one embodiment about 12 to about 500 carbon atoms, and in one embodiment about 18 to about 500 carbon atoms, and in one embodiment about 24 to about 500 carbon atoms, and in one embodiment about 30 to about 500 carbon atoms, and in one embodiment about 40 to about 500 carbon atoms, and in one embodiment about 50 to about 500 carbon atoms.

The hydrocarbyl substituent of the second acylating agent (II) may be derived from an alpha-olefin or an alpha-olefin fraction. The alpha-olefins include 1-dodecene, 1-tridecene, 1-tetradecene, 1-pentadecene, 1-hexadecene, 1-heptadecene, 1-octadecene, 1-eicosene, 1-docosene, 1-triacopntene, and the like. The alpha olefin fractions that are useful include $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{18-24}$ alpha-olefins, $C_{18-30}$ alpha-olefins, and the like. Mixtures of two or more of any of the foregoing alpha-olefins or alpha-olefin fractions may be used.

The hydrocarbyl groups of the first and second acylating agents (I) and (II) independently may be derived from an olefin oligomer or polymer. The olefin oligomer or polymer may be derived from an olefin monomer of 2 to about 10 carbon atoms, and in one embodiment about 3 to about 6 carbon atoms, and in one embodiment about 4 carbon atoms. Examples of the monomers include ethylene; propylene; butene-1; butene-2; isobutene; pentene-1; heptene-1; octene-1; nonene-1; decene-1; pentene-2; or a mixture of two of more thereof.

The hydrocarbyl groups of the first and/or second acylating agents (I) and (II) independently may be polyisobutene groups of the same or different molecular weights. Either or both of the polyisobutene groups may be made by the polymerization of a $C_4$ refinery stream having a butene content of about 35 to about 75% by weight and an isobutene content of about 30 to about 60% by weight.

The hydrocarbyl groups of the first and/or second acylating agents (I) and (II) independently may be polyisobutene groups derived from a polyisobutene having a high methylvinylidene isomer content, that is, at least about 50% by weight, and in one embodiment at least about 70% by weight methylvinylidenes. Suitable high methylvinylidene polyisobutenes include those prepared using boron trifluoride catalysts. The preparation of such polyisobutenes in which the methylvinylidene isomer comprises a high percentage of the total olefin composition is described in U.S. Pat. Nos. 4,152,499 and 4,605,808, the disclosure of each of which are incorporated herein by reference. An advantage of using these high methylvinylidene isomers is that the acylating agents (I) and (II) can be formed using a chlorine-free process which is significant when the fuel composition to which they are to be added is required to be a chlorine-fee or low-chlorine fuel.

In one embodiment, each of the hydrocarbyl substituents of each of the acylating agents (I) and (II) is a polyisobutene group, and each polyisobutene group independently has a number average molecular weight in the range of about 500 to about 3000, and in one embodiment about 900 to about 2400.

The hydrocarbyl substituent of the acylating agent (I) may be a polyisobutene group having a number average molecular weight of about 2000 to about 2600, and in one embodiment about 2200 to about 2400, and in one embodiment about 2300. The hydrocarbyl substituent of the acylating agent (II) may be a polyisobutene group having a number average molecular weight of about 700 to about 1300, and in one embodiment about 900 to about 1100, and in one embodiment about 1000.

The linking group (III) for linking the first acylating agent (I) with the second acylating agent (II) may be derived from a polyol, a polyamine or a hydroxyamine. The polyol may be a compound represented by the formula $$R—(OH)_m$$

wherein in the foregoing formula, R is an organic group having a valency of m, R is joined to the OH groups through carbon-to-oxygen bonds, and m is an integer from 2 to about 10, and in one embodiment 2 to about 6. The polyol may be a glycol. The alkylene glycols are useful. Examples of the polyols that may be used include ethylene glycol, diethylene glycol, triethylene glycol, tetraethylene glycol, propylene glycol, dipropylene glycol, tripropylene glycol, dibutylene glycol, tributylene glycol, 1,2-butanediol, 2,3-dimethyl-2,3-butanediol, 2,3-hexanediol, 1,2-cyclohexanediol, pentaerythritol, dipentaerythritol, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, 2,2,6,6-tetrakis-(hydroxymethyl) cyclohexanol, 1,10-decanediol, digitalose, 2-hydroxymethyl-2-methyl-1,3-propanediol-(tri-methylethane), or 2-hydroxymethyl-2-ethyl-1,3-propanediol-(trimethylpropane), and the like. Mixtures of two or more of the foregoing can be used.

The polyamines useful as linking compounds (III) for linking the acylating agents (I) and (II) may be aliphatic, cycloaliphatic, heterocyclic or aromatic compounds. Especially useful are the alkylene polyamines represented by the formula:

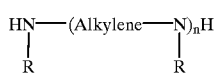

wherein n has an average value between 1 and about 10, and in one embodiment about 2 to about 7, the "Alkylene" group has from 1 to about 10 carbon atoms, and in one embodiment about 2 to about 6 carbon atoms, and each R is independently hydrogen, an aliphatic or hydroxy-substituted aliphatic group of up to about 30 carbon atoms. These alkylene polyamines include methylene polyamines, ethylene polyamines, butylene polyamines, propylene polyamines, pentylene polyamines, etc. Specific examples of such polyamines include ethylene diamine, triethylene tetramine, propylene diamine, trimethylene diamine, tripropylene tetramine, tetraethylene pentamine, hexaethylene heptamine, pentaethylene hexamine, or a mixture of two or more thereof.

Ethylene polyamines, such as some of those mentioned above, are useful as the linking compounds (III). Such polyamines are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring-opening reagent such as water, ammonia, etc. These reactions result in the production of a complex mixture of polyalkylene polyamines including cyclic condensation products such as piperazines.

The hydroxyamines useful as linking compounds (III) for linking the acylating agents (I) and (II) may be primary or secondary amines. The terms "hydroxyamine" and "aminoalcohol" describe the same class of compounds and, therefore, can be used interchangeably. In one embodiment, the hydroxyamine is (a) an N-(hydroxyl-substituted hydrocarbyl) amine, (b) a hydroxyl-substituted poly (hydrocarbyloxy) analog of (a), or a mixture of (a) and (b). The hydroxyamine may be an alkanol amine containing from 1 to about 40 carbon atoms, and in one embodiment 1 to about 20 carbon atoms, and in one embodiment 1 to about 10 carbon atoms.

The hydroxyamines useful as the linking compounds (III) may be a primary or secondary amines, or a mixture of two or more thereof. These hydroxyamines may be represented, respectfully, by the formulae:

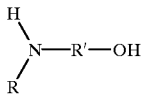

wherein each R is independently a hydrocarbyl group of one to about eight carbon atoms or hydroxyl-substituted hydrocarbyl group of two to about eight carbon atoms and R' is a divalent hydrocarbon group of about two to about 18 carbon atoms. Typically each R is a lower alkyl group of up to seven carbon atoms. The group —R'—OH in such formulae represents the hydroxyl-substituted hydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group.

The hydroxyamines useful as the linking compound (III) may be ether N-(hydroxy-substituted hydrocarbyl) amines. These may be hydroxyl-substituted poly(hydrocarbyloxy) analogs of the above-described hydroxyamines (these analogs also include hydroxyl-substituted oxyalkylene analogs). Such N-(hydroxyl-substituted hydrocarbyl) amines may be conveniently prepared by reaction of epoxides with afore-described amines and may be represented by the formulae:

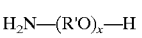

or

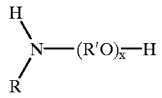

wherein x is a number from about 2 to about 15, and R and R' are as described above.

The hydroxyamine useful as the linking compound (III) for linking the acylating agents (I) and (II) may be one of the hydroxy-substituted primary amines described in U.S. Pat. No. 3,576,743 by the general formula wherein $R_a$ is a monovalent organic group containing at least one alcoholic hydroxy group. The total number of carbon atoms in $R_a$ preferably does not exceed about 20. Hydroxy-substituted aliphatic primary amines containing a total of up to about 10 carbon atoms are useful. The polyhydroxy-substituted alkanol primary amines wherein there is only one amino group present (i.e., a primary amino group) having one alkyl substituent containing up to about 10 carbon atoms and up to about 6 hydroxyl groups are useful. These alkanol primary amines correspond to $R_a$—$NH_2$ wherein $R_a$ is a mono-O or polyhydroxy-substituted alkyl group. It is desirable that at least one of the hydroxyl groups be a primary alcoholic hydroxyl group. Specific examples of the hydroxy-substituted primary amines include 2-amino-1-butanol, 2-amino-2-methyl-1-propanol, p-(beta-hydroxyethyl)-aniline, 2-amino-1-propanol, 3-amino-1-propanol, 2-amino-2-methyl-1,3-propanediol, 2-amino-2-ethyl-1,3-propanediol, N-(beta-hydroxypropyl)-N'-(beta-aminoethyl)-piperazine, tris-(hydroxymethyl) aminomethane (also known as trisrethylolaminomethane), 2-amino-1-butanol, ethanolamine, beta-(beta-hydrox yethoxy)-ethylamine, glucamine, glusoamine, 4-amimo-3-hydroxy-3-methyl-1-butene (that can be prepared according to procedures known in the art by reacting isopreneoxide with ammonia), N-3 (aminopropyl)-4-(2-hydroxyethyl)-piperadine, 2-amino-6-methyl-6-heptanol, 5-amino-1-pentanol, N-(beta-hydroxyethyl)-1,3-diamino propane, 1,3-diamino-2-hydroxypropane, N-(beta-hydroxy ethoxyethyl)-ethylenediamine, trisrmethylol aminomethane and the like.

Hydroxyalkyl alkylene polyamines having one or more hydroxyalkyl substituents on the nitrogen atoms may be used as the linking compound (III) for linking the acylating agents (I) and (II). Useful hydroxyalkyl-substituted alkylene polyamines include those in which the hydroxyalkyl group is a lower hydroxyalkyl group, i.e., having less than eight carbon atoms. Examples of such hydroxyalkyl-substituted polyamines include N-(2-hydroxyethyl) ethylene diamine, N,N-bis(2-hydroxyethyl) ethylene diamine, 1-(2-hydroxyethyl)-piperazine, monohydroxypropyl-substituted diethylene triamine, dihydroxypropyl-substituted tetraethylene pentamine, N-(3-hydroxybutyl) tetramethylene diamine, etc. Higher homologs as are obtained by condensation of the above-illustrated hydroxy alkylene polyamines through amino groups or through hydroxy groups are likewise useful. Condensation through amino groups results in a higher amine accompanied by removal of ammonia and condensation through the hydroxy groups results in products containing ether linkages accompanied by removal of water.

The amines (IV) which are useful along with ammonia in forming a salt with the acylating agents (I) and (II) include the amines and hydroxyamines discussed above as being useful as linking compounds (III) for linking the acylating agents (I) and (II). Also included are primary and secondary monoamines, tertiary mono- and polyamines, and tertiary alkanol amines. The tertiary amines are analogous to the primary amines, secondary amines and hydroxyamines discussed above with the exception that they may be either monoamines or polyamines and the hydrogen atoms in the H—N< or —$NH_2$ groups are replaced by hydrocarbyl groups.

The monoamines useful as the amines (IV) for forming a salt with the acylating agents (I) and (II) may be represented by the formula

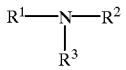

wherein $R^1$, $R^2$ and $R^3$ are the same or different hydrocarbyl groups. Preferably, $R^1$, $R^2$ and $R^3$ are independently hydrocarbyl groups of from 1 to about 20 carbon atoms, and in one embodiment from 1 to about 10 carbon atoms. Examples of useful tertiaryamines include trimethylamine, triethyl amine, tripropylamine, tributylamine, monomethyldiethylamine, monoethyidimethylamine, dimethylpropylamine, dimethylbutylamine, dimethylpentylamine, dimethylhexylamine, dimethyiheptylamine, dimethyloctyl amine, dimethylnonyl amine, dimethyldecyl amine, dimethylphenyl amine, N,N-dioctyl-1-octanamine, N,N-didodecyl-1-dodecanamine, tricocoamine, trihydrogenated-tallowamine, N-methyl-dihydrogenated-tallowamine, N,N-dimethyl-1-dodecanamine, N,N-dimetyl-1-tetradecanamine, N,N-dimethyl-1-hexadecanamine, N,N-dimethyl 1-octadecanamine, N,N-dimethylcocoamine, N,N-dimethylsoyaamine, N,N-dimethylhydrogenated-tallowamine, etc.

Tertiary alkanol amines which are useful as the amines (IV) for forming a salt with the acylating agents (I) and (II) include those represented by the formula:

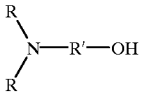

wherein each R is independently a hydrocarbyl group of one to about eight carbon atoms or hydroxyl-substituted hydrocarbyl group of two to about eight carbon atoms and R' is a divalent hydrocarbyl group of about two to about 18 carbon atoms. The groups —R'—OH in such formula represents the hydroxyl-substituted hydrocarbyl groups. R' may be an acyclic, alicyclic or aromatic group. Typically, R' is an acyclic straight or branched alkylene group such as an ethylene, 1,2-propylene, 1,2-butylene, 1,2-octadecylene, etc. group. Where two R groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiornorpholines, -piperidines, -oxazolidines, -thiazolidines, and the like. Typically, however, each R is a low alkyl group of up to seven carbon atoms. A useful hydroxyamine is dimethylaminoethanol. The hydroxyamines can also be ether N-(hydroxy-substituted hydrocarbyl)amines. These are hydroxyl-substituted poly(hydrocarbyloxy) analogs of the above-described hydroxy amines (these analogs also include hydroxyl-substituted oxyalkylene analogs). Such N-(hydroxyl-substituted hydrocarbyl) amines can be conveniently prepared by reaction of epoxides with afore-described amines and can be represented by the formula:

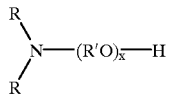

wherein x is a number from about 2 to about 15 and R and R' are described above.

Polyamines which are useful as the amines (IV) for forming a salt with the acylating agents (I) and (II) include the alkylene polyamines discussed above as well as alkylene polyamines with only one or no hydrogens attached to the nitrogen atoms. Thus, the alkylene polyamines useful as the amine (IV) include those conforming to the formula:

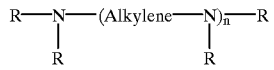

wherein n is from 1 to about 10, preferably from 1 to about 7; each R is independently a hydrogen atom, a hydrocarbyl group or a hydroxy-substituted hydrocarbyl group having up to about 700 carbon atoms, and in one embodiment up to about 100 carbon atoms, and in one embodiment up to about 50 carbon atoms, and in one embodiment up to about 30 carbon atoms; and the "Alkylene" group has from 1 to about 18 carbon atoms, and in one embodiment from 1 to about 6 carbon atoms.

These hydrocarbon fuel-soluble salt compositions may be prepared by initially reacting the acylating agents (I) and (II) with the linking compound (III) to form an intermediate, and thereafter reacting the intermediate with the ammonia or amine (IV) to form the desired salt. An alternative method involves reacting the acylating agent (I) and ammonia or amine (IV) with each other to form; a first salt moiety, separately reacting the acylating agent (II) and ammonia or amine (IV) (which can be the same or different ammonia or amine reacted with the acylating agent (I)) with each other to form a second salt moiety, then reacting a mixture of these two salt moieties with the linking compound (III).

The ratio of reactants ultilized in the preparation of these salt compositions may be varied over a wide range. Generally, for each equivalent of each of the acylating agents (I) and (II), at least about one equivalent of the linking compound (III) is used. From about 0.1 to about 2 equivalents or more of ammonia or amine (IV) are used for each equivalent of the acylating agents (I) and (II), respectively. The upper limit of linking compound (III) is about 2 equivalents of linking compound (III) for each equivalent of acylating agents (I) and (II). Generally the ratio of equivalents of acylating agent (I) to the acylating agent (II) is about 0.5 to about 2, with about 1:1 being useful. Useful amounts of the reactants include about 2 equivalents of the linking compound (III), and from about 0.1 to about 2 equivalents of the ammonia or amine (IV) for each equivalent of each of the acylating agents (I) and (I).

The number of equivalents of the acylating agents (I) and (II) depends on the total number of carboxylic functions present in each. In determining the number of equivalents for each of the acylating agents (I) and (II), those carboxyl functions which are not capable of reacting as a carboxylic acid acylating agent are excluded. In general, however, there is one equivalent of each acylating agent (I) and (II) for each carboxy group in the acylating agents. For example, there would be two equivalents in an anhydride derived from the reaction of one mole of olefin polymer and one mole of maleic anhydride.

The weight of an equivalent of a polyamine is the molecular weight of the polyamine divided by the total number of nitrogens present in the molecule. If the polyamine is to be used as linking compound (III), tertiary amino groups are not counted. One the other hand, if the polyamine is to used as a salt forming amine (IV), tertiary amino groups are counted. The weight of an equivalent of a commercially available mixture of polyamines can be determined by dividing the atomic weight of nitrogen (14) by the % N contained in the polyamine; thus, a polyamine mixture having a % N of 34 would have an equivalent weight of 41.2. The weight of an equivalent of ammonia or a monoamine is equal to its molecular weight.

The weight of an equivalent of a polyol is its molecular weight divided by the total number of hydroxyl groups present in the molecule. Thus, the weight of an equivalent of ethylene glycol is one-half its molecular weight.

The weight of an equivalent of a hydroxyamine which is to be used as a linking compound (III) is equal to its molecular weight divided by the total number of —OH, >NH and —$NH_2$ groups present in the molecule. On the other hand, if the hydroxyamine is to be used as a salt forming amine (IV), the weight of an equivalent thereof would be its molecular weight divided by the total number of nitrogen groups present in the molecule.

The acylating agents (I) and (II) may be reacted with the linking compound (III) according to conventional ester and/or amide-forming techniques. This normally involves heating acylating agents (I) and (II) with the linking compound (III), optionally in the presence of a normally liquid, substantially inert, organic liquid solvent/diluent. Temperatures of at least about 30° C. up to the decomposition temperature of the reaction component and/or product having the lowest such temperature can be used. This temperature may be in the range of about 50° C. to about 130° C., and in one embodiment about 80° C. to about 100° C. when the acylating agents (I) and (II) are anhydrides. On the other hand, when the acylating agents (I) and (II) are acids, this temperature is typically in the range of about 100° C. to about 300° C. with temperatures in the range of about 125° C. to about 250° C. often being employed.

The product made by this reaction is typically in the form of statistical mixture that is dependent on the charge of each of the acylating agents (I) and (II), and on the number of reactive sites on the linking compound (III). For example, if an equal molar ratio of acylating agents (I) and (II) is reacted with ethylene glycol, the product would be comprised of a mixture of (1) 50% of compounds wherein one molecule the acylating agent (I) is linked to one molecule of the acylating agent (II) through the ethylene glycol; (2) 25% of compounds wherein two molecules of the acylating agent (I) are linked together through the ethylene glycol; and (3) 25% of compounds wherein two molecules of the acylating agent (II) are linked together through the ethylene glycol.

The reactions between the acylating agents (I) and (II), and the salt forming ammonia or amine (IV) are carried out under salt forming conditions using conventional techniques. Typically, these components are mixed together and heated to a temperature in the range of about 20° C. up to the decomposition temperature of the reaction component and/or product having the lowest such temperature, and in one embodiment about 50° C. to about 130 C, and in one embodiment about 80 C to about 110° C.; optionally, in the presence of a normally liquid, substantially inert organic liquid solvent/diluent, until the desired salt product has formed.

The following examples are provided to illustrate the preparation of the component (i).

EXAMPLE 1

A twelve-liter, four-neck flask is charged with Adibis ADX 101G (7513 grams). Adibis ADX 101G, which is a product available from Lubrizol Adibis, is comprised of a polyisobutene substituted succinic anhydride mixture wherein 60% by weight is a first polyisobutene substituted succinic anhydride wherein the polyisobutene substituent has a number average molecular weight of 2300 and is derived from a polyisobutene having methylvinylidene isomer content of 80% by weight, and 40% by weight is a second polyisobutene-substituted succinic anhydride wherein the polyisobutene substituent has a number average molecular weight of 1000 and is derived from a polyisobutene having methylvinylidene isomer content of 85% by weight. The product has a diluent oil content of 30% by weight and a succination ratio of 1.4 (after correcting for unreacted polyisobutene). The flask is equipped with an overhead stirrer, a thermocouple, an addition funnel topped with an $N_2$ inlet, and a condenser. The succinic anhydride mixture is stirred and heated at 95° C., and ethylene glycol (137 grams) is added via the addition funnel over five minutes. The resulting mixture is stirred and maintained at 102–107° C. for 4 hours. Dimethylaminoethanol (392 grams) is charged to the mixture over 30 minutes is such that the reaction temperature does not exceed 107° C. The mixture is maintained at 100–105 C for 2 hours, and filtered to provide a brown, viscous product.

EXAMPLE 2

A three-liter, four-neck flask is charged with Adibis ADX 101G (1410 grams). The flask is equipped with an overhead stirrer, a thermocouple, an addition funnel topped with an $N_2$ inlet, and a condenser. The succinic anhydride mixture is stirred and heated to 61° C. Ethylene glycol (26.3 grams) is added via the addition funnel over five minutes. The resulting mixture is stirred and heated to 105–110° C. and maintained at that temperature for 4.5 hours. The mixture is cooled to 96° C., and dimethylaminoethanol (77.1 grams) is charged to the mixture over 5 minutes such that the reaction temperature does not exceed 100° C. The mixture is maintained at 95° C. for one hour, and then at 160° C. for four hours. The product is a brown, viscous product.

EXAMPLE 3

A reaction mixture comprising 196 parts by weight of mineral oil, 280 parts by weight of a polyisobutenyl (M.W. 1000)-substituted succinic anhydride (0.5 equivalent) and 15.4 parts of a commercial mixture of ethylene polyamine having an average composition corresponding to that of tetra ethylene pentamine (0.375 equivalent) is mixed over a period of approximately fifteen minutes. The reaction mass is then heated to 150° C. over a five-hour period and subsequently blown with nitrogen at a rate of five parts per hour for five hours while maintaining a temperature of 150° C. to 155° C. to remove water. The material is then filtered producing 477 parts of product in oil solution.

The hydrocarbon fuel soluble product (i) may be present in the aqueous hydrocarbon fuel compositions of the invention at a concentration of about 0.1 to about 15% by weight, and, in one embodiment about 0.1 to about 10% by weight, and in one embodiment about 0.1 to about 5% by weight, and in one embodiment about 0.1 to about 2% by weight, and in one embodiment about 0.1 to about 1% by weight, and in one embodiment about 0.1 to about 0.7% by weight.

The Ionic or Nonionic Compound (ii)

The ionic or nonionic compound (ii) has a hydrophilic lipophilic balance (HLB) in the range of about 1 to about 10, and in one embodiment about 4 to about 8. Examples of these compounds are disclosed in *McCutcheon's Emulsifiers and Detergents*, 1998, North American & International Edition. Pages 1–235 of the North American Edition and pages 1–199 of the International Edition are incorporated herein by reference for their disclosure of such ionic and nonionic compounds having an HLB in the range of about 1 to about 10. Useful compounds include alkanolamides, alkylarylsulfonates, amine oxides, poly(oxyalkylene) compounds, including block copolymers comprising alkylene oxide repeat units, carboxylated alcohol ethoxylates, ethoxylated alcohols, ethoxylated alkyl phenols, ethoxylated amines and amides, ethoxylated fatty acids, ethoxylated fatty esters and oils, fatty esters, fatty acid amides, glycerol esters, glycol esters, sorbitan esters, imidazoline derivatives, lecithin and derivatives, lignin and derivatives, monoglycerides and derivatives, olefin sulfonates, phosphate esters and derivatives, propoxylated and ethoxylated fatty acids or alcohols or alkyl phenols, sorbitan derivatives, sucrose esters and derivatives, sulfates or alcohols or ethoxylated alcohols or fatty esters, sulfonates of dodecyl and tridecyl benzenes or condensed naphthalenes or petroleum, sulfosuccinates and derivatives, and tridecyl and dodecyl benzene sulfonic acids.

In one embodiment, the ionic or nonionic compound (ii) is a poly(oxyalkene) compound. These include copolymers of ethylene oxide and propylene oxide. In one embodiment, the ionic or nonionic compound (ii) is a copolymer represented by the formula

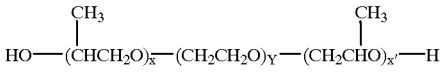

wherein x and x' are the number of repeat units of propylene oxide and y is the number of repeat units of ethylene oxide, as shown in the formula. In one embodiment, x and x' are independently numbers in the range of zero to about 20, and y is a number in the range of about 4 to about 60. In one embodiment, this copolymer has a number average molecular weight of about 1800 to about 3000, and in one embodiment about 2100 to about 2700.

In one embodiment, the ionic or nonionic compound (ii) is a hydrocarbon fuel-soluble product made by reacting an acylating agent having about 12 to about 30 carbon atoms with ammonia or an amine. The acylating agent may contain about 12 to about 24 carbon atoms, and in one embodiment about 12 to about 18 carbon atoms. The acylating agent may be a carboxylic acid or a reactive equivalent thereof. The reactive equivalants include acid halides, anhydrides, esters, and the like. These acylating agents may be monobasic acids or polybasic acids. The polybasic acids are preferably dicarboxylic, although tri- and tetra-carboxylic acids may be used. These acylating agents may be fatty acids. Examples include myristic acid, palmitic acid, stearic acid, oleic acid, linoleic acid, linolenic acid, and the like. These acylating agents may be succinic acids or anhydrides represented, respectively, by the formulae:

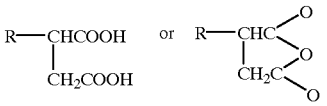

wherein each of the foregoing formulae R is a hydrocarbyl group of about 10 to about 28 carbon atoms, and in one embodiment about 12 to about 20 carbon atoms. Examples include tetrapropylene-substituted succinic acid or anhydride, hexadecyl succinic acid or anhydride, and the like. The amine may be any of the amines described above as being useful in making the hydrocarbon fuel-soluble product (i). The product of the reaction between the acylating agent and the ammonia or amine may be a salt, an ester, an amide, an imide, or a combination thereof. The salt may be an internal salt involving residues of a molecule of the acylating agent and the ammonia or amine wherein one of the carboxyl groups becomes ionically bound to a nitrogen atom within the same group; or it may be an external salt wherein the ionic-salt group is formed with a nitrogen atom that is not part of the same molecule. The reaction between the acylating agent and the ammonia or amine is carried out under conditions that provide for the formation of the desired product. Typically, the acylating agent and the ammonia or amine are mixed together and heated to a temperature in the range of from about 50° C. to about 250° C., and in one embodiment from about 80° C. to about 200° C.; optionally in the presence of a normally liquid, substantially inert organic liquid solvent/diluent, until the desired product has formed. In one embodiment, the acylating agent and the ammonia or amine are reacted in amounts sufficient to provide from about 0.3 to about 3 equivalents of acylating agent per equivalent of ammonia or amine. In one embodiment, this ratio is from about 0.5:1 to about 2:1, and in one embodiment about 1:1.

In one embodiment, the ionic or nonionic compound (ii) is an ester/salt made by reacting hexadecyl succinic anhydride with dimethylethanolamine in an equivalent ratio (i.e., carbonyl to amine ratio) of about 1:1 to about 1:1.5, and in one embodiment about 1:1.35.

The ionic or nonionic compound (ii) may be present in the aqueous hydrocarbon fuel compositions of the invention at a concentration of about 0.01 to about 15% by weight, and in one embodiment about 0.01 to about 10% by weight, and one embodiment about 0.01 to about 5% by weight, and in one embodiment about 0.01 to about 3% by weight, and in one embodiment about 0.1 to about 1% by weight.

The Water-Soluble Salt (iii)

The water-soluble salt (iii) may be any material capable of forming positive and negative ions in an aqueous solution that does not interfere with the other additives or the hydrocarbon fuel. These include organic amine nitrates, azides, and nitro compounds. Also included are alkali and alkaline earth metal carbonates, sulfates, sulfides, sulfonates, and the like. Particularly useful are the amine or ammonium salts represented by the formula $$k[G(NR_3)_y]^{y+}nX^{p-}$$

wherein G is hydrogen or an organic group of 1 to about 8 carbon atoms, and in one embodiment 1 to about 2 carbon atoms, having a valence of y; each R independently is hydrogen or a hydrocarbyl group of 1 to about 10 carbon atoms, and in one embodiment 1 to about 5 carbon atoms, and in one embodiment 1 to about 2 carbon atoms; $X^{p-}$ is an anion having a valence of p; and k, y, n and p are independently integers of at least 1. When G is H, y is 1. The sum of the positive charge $ky^+$ is equal to the sum of the negative charge $nX^{p-}$. In one embodiment, X is a nitrate ion; and in one embodiment it is an acetate ion. Examples include ammonium nitrate, ammonium acetate, methylammonium nitrate, methylammonium acetate, ethylene diamine diacetate, ureanitrate, and urea dinitrate. Ammonium nitrate is particularly useful.

In one embodiment, the water-soluble salt (iii) functions as an emulsion stabilizer, i.e., it acts to stabilize the aqueous hydrocarbon fuel compositions.

In one embodiment, the water-soluble salt (iii) functions as a combustion improver. A combustion improver is characterized by its ability to increase the mass burning rate of the fuel composition. Thus, the presence of such combustion improvers has the effect of improving the power output of an engine.

The water-soluble salt (iii) may be present in the aqueous hydrocarbon fuel compositions of the invention at a concentration of about 0.001 to about 1% by weight, and in one embodiment from about 0.01 to about 1% by weight.

Cetane Improver

In one embodiment, the aqueous hydrocarbon fuel composition of the invention contains a cetane improver. The cetane improvers that are useful include peroxides, nitrates, nitrites, nitrocarbamates, and the like. Useful cetane improvers include nitropropane, dinitropropane, tetranitromethane, 2-nitro-2-methyl-1-butanol, 2-methyl-2-nitro-1-propanol, and the like. Also included are nitrate esters of substituted or unsubstituted aliphatic or cycloaliphatic alcohols that may be monohydric or polyhydric. These include substituted and unsubstituted alkyl or cycloalkyl nitrates having up to about 10 carbon atoms, and in one embodiment about 2 to about 10 carbon atoms. The alkyl group may be either linear or branched, or a mixture of linear or branched alkyl groups. Examples include methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, n-heptyl nitrate, n-octyl nitrate, 2-ethylhexyl nitrate, sec-octyl nitrate, n-nonyl nitrate, n-decyl nitrate, cyclopentyl nitrate, cyclohexyl nitrate, methylcyclohexyl nitrate, and isopropylcyclohexyl nitrate. Also useful are the nitrate esters of alkoxy substituted aliphatic alcohols such as 2-ethoxyethyl nitrate, 2-(2-ethoxy-ethoxy) ethyl nitrate, 1-methoxypropyl-2-nitrate, 4-ethoxybutyl nitrate, etc., as well as diol nitrates such as 1,6-hexamethylene dinitrate. A particularly useful cetane improver is 2-ethylhexyl nitrate.

The concentration of the cetane improver in the aqueous hydrocarbon fuel compositions of the invention can be any concentration sufficient to provide such compositions with the desired cetane number. In one embodiment, the concentration of the cetane improver is at a level of up to about 10% by weight, and in one embodiment about 0.05 to about 10% by weight, and in one embodiment about 0.05 to about 5% by weight, and in one embodiment about 0.05 to about 1% by weight.

Additional Additives

In addition to the foregoing chemical additives, other additives that are well known to those of skill in the art can be used. These include antiknock agents such as tetraalkyl lead compounds, lead scavengers such as haloalkanes (e.g., ethylene dichloride and ethylene dibromide), ashless dispersants, deposit preventers or modifiers such as triaryl phosphates, dyes, cetane improvers, anti-oxidants such as 2,6-di-tertiary-butyl-4-methylphenol, rust inhibitors such as alkylated succinic acids and anhydrides, bacteriostatic agents, gum inhibitors, metal deactivators, demulsifiers, upper cylinder lubricants and anti-icing agents. These chemical additives can be used at concentrations of up to about 1% by weight based on the total weight of the aqueous hydrocarbon fuel compositions, and in one embodiment about 0.01 to about 1% by weight.

The total concentration of chemical additives in the aqueous hydrocarbon fuel compositions of the invention may range from about 0.05 to about 30% by weight, and in one embodiment about 0.1 to about 20% by weight, and in one embodiment about 0.1 to about 15% by weight, and in one embodiment about 0.1 to about 10% by weight, and in one embodiment about 0.1 to about 5% by weight.

Organic Solvent

The chemical additives may be diluted with a substantially inert, normally liquid organic solvent such as naphtha, benzene, toluene, xylene or a normally liquid hydrocarbon fuel as described above, to form an additive concentrate which is then mixed with the normally liquid hydrocarbon fuel pursuant to this invention. These concentrates generally contain from about 10% to about 90% by weight of the foregoing solvent. The aqueous hydrocarbon fuel compositions may contain up to about 60% by weight organic solvent, and in one embodiment about 0.01 to about 50% by weight, and in one embodiment about 0.01 to about 20% by weight, and in one embodiment about 0.1 to about 5% by weight, and in one embodiment about 0.1 to about 3% by weight.

Antifreeze Agent

In one embodiment, the aqueous hydrocarbon fuel compositions of the invention contain an antifreeze agent. The antifreeze agent is typically an alcohol. Examples include ethylene glycol, propylene glycol, methanol, ethanol, and mixtures thereof. Methanol, ethanol and ethylene glycol are particularly useful. The antifreeze agent is typically used at a concentration sufficient to prevent freezing of the water used in the inventive composition. The concentration is therefore dependent upon the temperature at which the process is operated or the temperature at which the fuel is stored or used. In one embodiment, the concentration is at a level of up to about 10% by weight, and in one embodiment about 0.1 to about 10% by weight of the aqueous hydrocarbon fuel composition, and in one embodiment about 1 to about 5% by weight.

EXAMPLE 4

This example provides an illustrative example of the aqueous hydrocarbon fuel compositions of the invention. The numerical values indicated below are in parts by weight.

| Components | A |
|---|---|
| BP Supreme Diesel Fuel | 78.8 |
| Deionized Water | 19.8 |
| Emulsifier 1[1] | 0.51 |
| Emulsifier 2[2] | 0.09 |
| Organic Solvent[3] | 0.35 |

-continued

| Components | A |
|---|---|
| 2-Ethylhexyl nitrate | 0.35 |
| Ammonium nitrate | 0.10 |

[1]Ester/salt prepared by reacting polyisobutene ($M_n$ = 2000) substituted succinic anhydride (ratio of succinic groups to polyisobutene equivalent weights of 1.7–2.0) with dimethylethanolamine in a equivalent weight ratio of 1:1 (1 mole succinic anhydride acid group to 2 moles of amine).
[2]Ester/salt prepared by reacting a hexadecyl succinic anhydride with diethanolamine at a mole ratio of 1:1.35.
[3]Aromatic solvent available under the name "SC-150" (Ohio Solvents), having a flash point of 60□C., and initial and final boiling points of 188□C. and 210□C.

An aqueous hydrocarbon fuel composition having the foregoing formulation A is prepared using the process and apparatus described above. The high shear mixer 10 is a Dispax-Reactor DR 3/9 made by IKA-Maschinbau equipped with a 20 HP motor. The mixer has three Ultra-Turrax UTL-T./8 rotor-stators arranged in series. These rotor-stators are sometimes referred to as superfine generators. The rotors rotate at 5500 rpm. The inlet to the mixer 10 is a two-inch inlet. The blend tank 12 has a 120-gallon capacity. The batch size is 100 gallons (730 pounds). The following time cycle is used.

| | | Elapsed Time |
|---|---|---|
| (1) | Diesel fuel and chemical additives are added to blend tank 12. High shear mixer 10 is turned on when the volume in the blend tank 12 reaches 30 gallons. | 2.5 minutes |
| (2) | Water is charged to water storage tank 18. | 4.1 minutes |
| (3) | Mixing in high shear mixer 10 begins once the water charge is complete. | 30 minutes |
| (4) | Transfer to storage tank 22 at the end of high shear mixing. | 3 minutes |

The temperature of the batch is initially at 75° F. (23.9° C.) and increases to 117° F. (47.2° C.) during mixing. A sample of the aqueous hydrocarbon fuel composition is taken at 28.5 minutes into the mixing cycle and analyzed for droplet size of the aqueous phase. A plot of the droplet size of the aqueous phase is provided in FIG. 5. FIG. 5 shows a distribution of droplets with a mean diameter of 0.45 micron.

EXAMPLE 5

Additional formulations for the aqueous hydrocarbon fuel compositions of the invention are indicated below. The numerical values indicated below are in parts by weight. The Emulsifier 1, Emulsifier 2 and Organic Solvent indicated below are the same as indicated in Example 4.

| | B | C | D | E | F |
|---|---|---|---|---|---|
| Diesel Fuel | 78.68 | 78.80 | 78.45 | 79.15 | 78.80 |
| Dionized Water | 19.80 | 19.80 | 19.80 | 15.00 | 15.80 |
| Emulsifier 1 | 0.60 | — | 0.68 | 3.00 | 0.51 |
| Emulsifier 2 | — | 0.60 | 0.12 | 1.50 | 0.09 |
| Organic Solvent | 0.35 | 0.35 | 0.35 | 0.35 | 0.35 |
| 2-Ethylhexyl nitrate | 0.47 | 0.35 | 0.47 | 0.50 | 0.35 |
| Ammonium nitrate | 0.10 | 0.10 | 0.13 | 0.50 | 0.10 |
| Methanol | — | — | — | — | 3.00 |

EXAMPLE 6

This example is illustrative of concentrates that can be used to make the aqueous hydrocarbon fuel compositions of the invention. The numerical values indicated below are in parts by weight. The Emulsifier 2 and Organic Solvent indicated below are the same as indicated in Example 4.

| | G | H |
|---|---|---|
| Product of Example 1 | 34 | — |
| Product of Example 2 | — | 34 |
| Emulsifier 2 | 6 | 6 |
| Organic Solvent | 23.2 | 23.2 |
| 2-Ethylhexyl nitrate | 23.8 | 23.8 |
| Aqueous ammonium nitrate (54% by wt ammonium nitrate) | 13 | 13 |

EXAMPLE 7

This example discloses aqueous hydrocarbon fuel compositions using the concentrates disclosed in Example 6. In the table below all numerical values are in parts by weight.

| | I | J |
|---|---|---|
| Diesel Fuel | 79–81 | 79–81 |
| Water | 18–20 | 18–20 |
| Concentrate G | 1.5–3 | — |
| Concentrate H | — | 1.5–3 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process for making an aqueous hydrocarbon fuel composition, comprising:

(A) mixing a normally liquid hydrocarbon fuel and at least one chemical additive to form a hydrocarbon fuel-additive mixture, wherein said chemical additive comprises an emulsifier composition which comprises: (i) a combination of (i)(a) a first hydrocarbon fuel-soluble product made by reacting a first carboxylic acid acylating agent with an alkanol amine, said first carboxylic acid acylating agent having a hydrocarbyl substituent containing about 50 to about 500 carbon atoms, and (i)(b) a second hydrocarbon fuel-soluble product made by reacting a second carboxylic acid acylating agent with at least one ethylene polyamine, said second carboxylic acid acylating agent having a hydrocarbyl substituent containing about 50 to about 500 carbon atoms; (ii) optionally an ionic or a nonionic compound having a hydrophilic lipophilic balance of about 1 to about 10; and (iii) an emulsion stabilizing and combustion improving amount of a water-soluble salt represented by the formula $$k[G(NR_3)_y]^{y+}nX^{p-}$$

wherein G is hydrogen or an organic group of 1 to about 8 carbon atoms having a valence of y; each R independently is hydrogen or a hydrocarbyl group of 1 to about 10 carbon atoms; $X^{p-}$ is an anion having a valence of p; and k, y, n and p are independently integers of at least 1; and (B) mixing said hydrocarbon fuel-additive mixture with water under high shear mixing conditions in a high shear mixer to form said aqueous hydrocarbon fuel composition, said aqueous hydrocarbon fuel composition including a discontinuous aqueous phase, said discontinuous aqueous phase being comprised of aqueous droplets having a mean diameter of 1.0 micron or less.

2. The process of claim 1 wherein an antifreeze agent is added to said water, and then said hydrocarbon fuel-additive mixture is mixed with said water and said antifreeze agent during step (B) to form said aqueous hydrocarbon fuel composition.

3. The process of claim 1 wherein said high-shear mixer is a rotor-stator mixer having a first rotor-stator and a second rotor-stator arranged in series, said hydrocarbon fuel-additive mixture and said water being mixed in said first rotor-stator and then said second rotor-stator to form said aqueous hydrocarbon fuel composition.

4. The process of claim 3 wherein said high-shear mixer further comprises a third rotor-stator arranged in series with said first rotor-stator and said second rotor-stator, said hydrocarbon fuel-additive mixture and said water advancing through said first rotor-stator, then through said second rotor-stator, and then through said third rotor-stator to form said aqueous hydrocarbon fuel composition.

5. The process of claim 1 wherein said high-shear mixer is an ultrasonic mixer.

6. The process of claim 1 wherein said high-shear mixer is a high-pressure homogenizer.

7. The process of claim 1 wherein said hydrocarbon fuel-additive mixture and said water are advanced through said high shear mixer one time to form said aqueous hydrocarbon fuel composition, and then said aqueous hydrocarbon fuel composition is recycled through said high-shear mixer 1 to about 35 additional times.

8. The process of claim 1 wherein during step (A) said hydrocarbon fuel and said chemical additive flow in separate streams to a blend tank where they are mixed to form said hydrocarbon fuel-additive mixture, and during step (B) said hydrocarbon fuel-additive mixture and said water flow in separate streams (i) to said high shear mixer where they are mixed under high shear mixing conditions or (ii) to a conduit at the entrance to said high shear mixer where they are initially mixed for up to about 15 seconds and then to said high shear mixer where they are mixed under high shear mixing conditions to form said aqueous hydrocarbon fuel mixture; the flow of said hydrocarbon fuel, said chemical additive, said hydrocarbon fuel-additive mixture and said water being controlled by a programmable logic controller, and the mixing of said hydrocarbon fuel and said chemical additive during step (A) and the mixing of said hydrocarbon fuel-additive mixture and said water during step (B) being controlled by said programmable logic controller.

9. The process of claim 8 wherein said programmable logic controller is programmed by a programming computer communicating with said programmable logic controller.

10. The process of claim 9 wherein said process is conducted at a fuel dispensing location and said programming computer is located at said fuel-dispensing location.

11. The process of claim 9 wherein said process is conducted at a fuel-dispensing location and said computer is located at a location that is remote from said fuel-dispensing location.

12. The process of claim 8 wherein said process is conducted at one fuel-dispensing location and it is also conducted at another fuel-dispensing location located remote from said one fuel-dispensing location, said process being conducted at said one fuel-dispensing location being controlled by one programmable logic controller, and said process being conducted at said another fuel-dispensing location being controlled by another programmable logic controller, a programming computer being located at a location remote from said one fuel-dispensing location and from said another fuel-dispensing location, said programming computer being adapted for programming said one programmable logic controller and said another programmable logic controller.

13. The process of claim 8 wherein said process is monitored by a monitoring computer communicating with said programmable logic controller.

14. The process of claim 13 wherein said process is conducted at a fuel-dispensing location and said monitoring computer is located at said fuel-dispensing location.

15. The process of claim 13 wherein said process is conducted at a fuel-dispensing location and said monitoring computer is located at a location that is remote from said fuel-dispensing location.

16. The process of claim 8 wherein said process is conducted at one fuel-dispensing location and it is also conducted at another fuel dispensing location located remote from said one fuel-dispensing location, said process being conducted at said one fuel-dispensing location being controlled by one programmable logic controller, and said process being conducted at said another fuel-dispensing location being controlled by another programmable logic controller, a monitoring computer being located at a location remote from said one fuel-dispensing location and from said another fuel-dispensing location, said monitoring computer communicating with said one programmable logic controller and said another programmable logic controller and being adapted for monitoring said process.

17. The process of claim 1 wherein said normally liquid hydrocarbon fuel is a diesel fuel or gasoline.

18. The process of claim 1 wherein said normally liquid hydrocarbon fuel is a diesel fuel.

19. The process of claim 1 wherein said chemical additive comprises a mixture of (i), (ii) and (iii).

20. The process of claim 1, wherein said alkanol amine is selected from the group consisting of a dimethylethanolamine or a diethylethanolamine.

21. The process of claim 1, wherein the component (i)(a) is made from a polyisobutylene having a number average molecular weight range of from about 1500 to about 3000 and which is maleinated or succinated in the range of from 1.3 to 2.5.

22. The process of claim 1, wherein said ethylene polyamine is selected from the group consisting of TEPA, PEHA, or TETA.

23. The process of claim 1, wherein said ethylene polyamine is selected from the group consisting of polyamine bottoms or at least one heavy polyamine.

24. The process of claim 1, wherein component (i)(b) is a hydrocarbon fuel-soluble product made by reacting an acylating agent with at least one ethylene polyamine in an equivalent ratio of CO:N of from 1:1.5 to 1:0.5.

25. The process of claim 1, wherein component (i)(b) is a hydrocarbon fuel-soluble product made by reacting an acylating agent with at least one ethylene polyamine in an equivalent ratio of CO:N of from 1:1.3 to 1:0.70.

26. The process of claim 1, wherein component (i)(b) is a hydrocarbon fuel-soluble product made by reacting an acylating agent with at least one ethylene polyamine in an equivalent ratio of CO:N of from 1:1 to 1:0.70.

27. The process of claim 1, wherein said component (i)(b) is made from a polyisobutylene having a number average molecular weight range of from about 700 to about 1300 and which is succinated in the range from 1.0 up to 1.3.

28. The process of claim 1, wherein component (i)(b) is combined with component (i)(a) in an amount from about 0.05% to about 0.95% based upon the total weight of component (i).

29. The process of claim 1 wherein said chemical additive further comprises a cetane improver.

30. The process of claim 1 wherein said hydrocarbon fuel-additive mixture includes an organic solvent.

31. The process of claim 2 wherein said antifreeze agent is methanol, ethanol or ethylene glycol.

32. The process of claim 1 wherein said aqueous hydrocarbon fuel composition comprises from about 50 to about 95% by weight of said hydrocarbon fuel; about 5 to about 40% by weight of said water; and about 0.05 to about 30% by weight of said chemical additive.

33. The process of claim 2 wherein said aqueous hydrocarbon fuel composition comprises from about 50 to about 95% by weight of said hydrocarbon fuel, from about 5 to about 40% by weight of said water, from about 0.05 to about 30% by weight of said chemical additive, and from about 0.1 to about 10% by weight of said antifreeze agent.

34. The process of claim 1 wherein said droplets have a mean diameter of about 0.01 to about 0.7 micron.

35. A process for making an aqueous diesel fuel composition, comprising (A) mixing a diesel fuel and a chemical additive to form a diesel fuel-additive mixture, said chemical additive comprising an emulsifier composition which comprises: (i) a combination of (i)(a) a first diesel fuel-soluble product made by reacting a first hydrocarbyl substituted carboxylic acid acylating agent with an alkanol amine, the hydrocarbyl substituent of said first acylating agent having about 50 to about 500 carbon atoms, and (i)(b) a second diesel fuel-soluble product made by reacting a second hydrocarbyl substituted carboxylic acid acylating agent with at least one ethylene polyamine, the hydrocarbyl substituent of said second acylating agent having about 50 to about 500 carbon atoms; (ii) optionally an ionic or a nonionic compound having a hydrophilic lipophilic balance of about 1 to about 10; and (iii) an emulsion stabilizing and combustion improving amount of a water-soluble salt represented by the formula $$k[G(NR_3)_y]^{y+}nX^{p-}$$

wherein G is hydrogen or an organic group of 1 to about 8 carbon atoms having a valence of y; each R independently is hydrogen or a hydrocarbyl group of 1 to about 10 carbon atoms; $X^{p-}$ is an anion having a valence of p; and k, y, n and p are independently integers of at least 1; and (B) mixing said diesel fuel-additive mixture and water under high shear mixing conditions in a high shear mixer to form said aqueous diesel fuel composition, said high shear mixer being a rotor-stator mixer comprising a first rotor-stator, a second rotor-stator and a third rotor-stator arranged in series, said diesel fuel-additive mixture and said water being mixed in said first rotor-stator, then said second rotor-stator and then said third rotor stator to form said aqueous diesel fuel composition, said aqueous diesel fuel composition including a discontinuous aqueous phase, said discontinuous aqueous phase being comprised of aqueous droplets having a mean diameter of 1.0 micron or less.

36. The process of claim 35, wherein said alkanol amine is selected from the group consisting of a dimethylethanolamine or a diethylethanolamine.

37. The process of claim 35 wherein the component (i)(a) is made from a polyisobutylene having a number average molecular weight range of from about 1500 to about 3000 and which is maleinated or succinated in the range of from 1.3 to 2.5.

38. The process of claim 35, wherein said ethylene polyamine selected from the group consisting of TEPA, PEHA, or TETA.

39. The process of claim 35, wherein said ethylene polyamine is selected from the group consisting of polyamine bottoms or at least one heavy polyamine.

40. The process of claim 35, wherein component (i)(b) is a hydrocarbon fuel-soluble product made by reacting an acylating agent with at least one ethylene polyamine in an equivalent ratio of CO:N of from 1:1.5 to 1:0.5.

41. The process of claim 35, wherein component (i)(b) is a hydrocarbon fuel-soluble product made by reacting an acylating agent with at least one ethylene polyamine in an equivalent ratio of CO:N of from 1:1.3 to 1:0.70.

42. The process of claim 35, wherein component (i)(b) is a hydrocarbon fuel-soluble product made by reacting an acylating agent with at least one ethylene polyamine in an equivalent ratio of CO:N of from 1:1 to 1:0.70.

43. The process of claim 35, wherein said component (i)(b) is made from a polyisobutylene having a number average molecular weight range of from about 700 to about 1300 and which is succinated in the range from 1.0 up to 1.3.

44. The process of claim 35, wherein component (i)(b) is combined with component (i)(a) in an amount from about 0.05% to about 0;95% based upon the total weight of component (i).

45. An aqueous hydrocarbon fuel composition, comprising: a continuous phase of a normally liquid hydrocarbon fuel; a discontinuous aqueous phase, said discontinuous aqueous phase being comprised of aqueous droplets having a mean diameter of 1.0 micron or less; and an emulsifying amount of an emulsifier composition comprising (i) a combination of (i)(a) a first hydrocarbon fuel-soluble product made by reacting a first hydrocarbyl substituted carboxylic acid acylating agent with an alkanol amine, the hydrocarbyl substituent of said first acylating agent having about 50 to about 500 carbon atoms, and (i)(b) a second hydrocarbon fuel-soluble product made by reacting a second hydrocarbyl substituted carboxylic acid acylating agent with at least one ethylene polyamine, the hydrocarbyl substituent of said second acylating agent having about 50 to about 500 carbon atoms; (ii) optionally an ionic or a nonionic compound having a hydrophilic lipophilic balance of about 1 to about 10; in combination with (iii) an emulsion stabilizing and combustion improving amount of a water-soluble salt represented by the formula $$k[G(NR_3)_y]^{y+}nX^{p-}$$

wherein G is hydrogen or an organic group of 1 to about 8 carbon atoms having a valence of y; each R independently is hydrogen or a hydrocarbyl group of 1 to about 10 carbon atoms; $X^{p-}$ is an anion having a valence of p; and k, y, n and p are independently integers of at least 1.

46. The aqueous hydrocarbon fuel composition of claim 45 wherein said emulsifier composition comprises a mixture of (i), (ii) and (iii).

47. The aqueous hydrocarbon fuel composition of claim 45, wherein said alkanol amine is selected from the group consisting of a dimethylethanolamine or a diethylethanolamine.

48. The aqueous hydrocarbon fuel composition of claim 45, wherein said component (i)(a) is made from a polyisobutylene having a number average molecular weight range of from about 1500 to about 3000 and which is maleinated or succinated in the range of from 1.3 to 2.5.

49. The aqueous hydrocarbon fuel composition of claim 45, wherein said ethylene polyamine selected from the group consisting of TEPA, PEHA, or TETA.

50. The aqueous hydrocarbon fuel composition of claim 45, wherein said ethylene polyamine is selected from the group consisting of polyamine bottoms or at least one heavy polyamine.

51. The aqueous hydrocarbon fuel composition of claim 45, wherein component (i)(b) is a hydrocarbon fuel-soluble product made by reacting an acylating agent with at least one ethylene polyamine in an equivalent ratio of CO:N of from 1:1.5 to 1:0.5.

52. The aqueous hydrocarbon fuel composition of claim 45, wherein component (i)(b) is a hydrocarbon fuel-soluble product made by reacting an acylating agent with at least one ethylene polyamine in an equivalent ratio of CO:N of from 1:1.3 to 1:0.70.

53. The aqueous hydrocarbon fuel composition of claim 45, wherein component (i)(b) is a hydrocarbon fuel-soluble product made by reacting an acylating agent with at least one ethylene polyamine in an equivalent ratio of CO:N of from 1:1 to 1:0.70.

54. The aqueous hydrocarbon fuel composition of claim 45, wherein said component (i)(b) is made from a polyisobutylene having a number average molecular weight range of from about 700 to about 1300 and which is succinated in the range from 1.0 up to 1.3.

55. The aqueous hydrocarbon fuel composition of claim 45, wherein component (i)(b) is combined with component (i)(a) in an amount from about 0.05% to about 0.95% based upon the total weight of component (i).

56. The aqueous hydrocarbon fuel composition of claim 45 wherein said hydrocarbon fuel is gasoline or diesel fuel.

57. The aqueous hydrocarbon fuel composition of claim 45 wherein said hydrocarbon fuel is diesel fuel.

58. The aqueous hydrocarbon fuel composition of claim 45 wherein said fuel composition further comprises an antifreeze agent.

59. The aqueous hydrocarbon fuel composition of claim 45 wherein said fuel composition further comprises a cetane improver.

60. The aqueous hydrocarbon fuel composition of claim 45 wherein said fuel or composition further comprises an organic solvent.

61. The aqueous hydrocarbon fuel composition of claim 58 wherein said antifreeze agent is methanol, ethanol or ethylene glycol.

62. The aqueous hydrocarbon fuel composition process of claim 45 wherein said fuel composition comprises from about 50 to about 95% by weight of said hydrocarbon fuel; about 5 to about 40% by weight of said water; and about 0.05 to about 20% by weight of said emulsifier composition.

63. The aqueous hydrocarbon fuel composition of claim 45 wherein said aqueous hydrocarbon fuel composition comprises from about 50 to about 95% by weight of said hydrocarbon fuel, from about 5 to about 40% by weight of water, from about 0.05 to about 20% by weight of said emulsifier composition, and from about 0.1 to 10% by weight of said antifreeze agent.

64. The aqueous hydrocarbon fuel composition of claim 45 wherein said droplets have a mean diameter of about 0.01 to about 0.7 micron.

65. A process for fueling an internal combustion engine comprising fueling said engine with the fuel composition of claim 45.

66. A process for fueling an internal combustion engine comprising fueling said engine with the fuel composition of claim 46.

* * * * *